US010745908B2

(12) United States Patent
Studer et al.

(10) Patent No.: US 10,745,908 B2
(45) **Date of Patent: *Aug. 18, 2020**

(54) DECK MOUNTING SYSTEM

(71) Applicant: Studer Residential Designs Inc., Cold Spring, KY (US)

(72) Inventors: Paul Studer, Cold Spring, KY (US); Michael Frimming, Cold Spring, KY (US); Michael A. Studer, Wilder, KY (US); Donald Roenker, Taylor Mill, KY (US)

(73) Assignee: Studer Residential Designs, Inc., Cold Spring, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/361,485

(22) Filed: Mar. 22, 2019

(65) Prior Publication Data

US 2019/0218767 A1 Jul. 18, 2019

Related U.S. Application Data

(63) Continuation-in-part of application No. 15/676,269, filed on Aug. 14, 2017, now Pat. No. 10,240,340.

(51) Int. Cl.

| | |
|---|---|
| ***E04B 1/41*** | (2006.01) |
| ***E04B 1/00*** | (2006.01) |
| ***E04B 1/38*** | (2006.01) |

(52) U.S. Cl.

CPC ..... *E04B 1/40* (2013.01); *E04B 1/003* (2013.01); *E04B 2001/405* (2013.01)

(58) Field of Classification Search

CPC ..... E04B 1/40; E04B 1/2604; E04B 1/003; E04B 2001/405; E04B 2001/2644

See application file for complete search history.

(56) References Cited

U.S. PATENT DOCUMENTS

| | | | | |
|---|---|---|---|---|
| 3,890,759 | A | 6/1975 | Selden et al. | |
| 4,811,542 | A | 3/1989 | Jewell | |
| 4,953,339 | A | 9/1990 | Jewell | |
| 5,513,476 | A | 5/1996 | Jones | |
| 5,611,179 | A | 3/1997 | Leek | |
| 5,746,421 | A * | 5/1998 | Bowerman ..... | E04D 13/158 269/41 |
| 6,311,449 | B1 | 11/2001 | Morse et al. | |

(Continued)

FOREIGN PATENT DOCUMENTS

KR 20170018723 A * 2/2017

*Primary Examiner* — Rodney Mintz

(74) *Attorney, Agent, or Firm* — Wood Herron & Evans LLP

(57) ABSTRACT

A mounting system for mounting an external structure, such as a deck, with a building includes an anchor frame that couples with structural elements of the building and a bracket that couples with both the external structure and the anchor frame for securement. The anchor frame includes a plate element configured for mounting against a board of a building and anchor elements extending from the plate element and configured for mounting against a second board of a building. The bracket has a first face portion configured for coupling with the anchor frame and a second face portion spaced from the first face portion and configured for mounting with an external structure.

20 Claims, 20 Drawing Sheets

(56) References Cited

U.S. PATENT DOCUMENTS

| | | | | |
|---|---|---|---|---|
| 6,397,552 | B1 * | 6/2002 | Bourque | E04B 1/003 52/712 |
| 6,427,391 | B1 | 8/2002 | Lyons | |
| 6,817,157 | B2 * | 11/2004 | Bourque | E04B 1/003 52/712 |
| 7,419,335 | B1 | 9/2008 | Cohen | |
| 7,861,469 | B2 | 1/2011 | Heady et al. | |
| 8,607,515 | B2 | 12/2013 | Jarvis | |
| 8,621,802 | B2 | 1/2014 | Spyrou | |
| 8,925,267 | B1 | 1/2015 | Kirby | |
| 9,045,892 | B2 | 6/2015 | Smith et al. | |
| 9,091,090 | B1 | 7/2015 | Kirby | |
| 9,194,118 | B2 | 11/2015 | Spyrou | |
| 9,598,854 | B2 * | 3/2017 | Ter-Borch | E06B 1/02 |
| 10,024,046 | B2 * | 7/2018 | Higginbotham | E04B 5/12 |
| 10,060,118 | B2 * | 8/2018 | Callahan | E04B 1/003 |
| 10,240,340 | B2 * | 3/2019 | Studer | E04B 1/40 |
| 10,253,495 | B1 * | 4/2019 | Calini | E04B 7/045 |
| 10,323,419 | B2 * | 6/2019 | Hatzinikolas | E04F 13/0801 |
| 10,392,820 | B2 * | 8/2019 | Heady | E04B 7/045 |
| 10,590,644 | B2 * | 3/2020 | Naylor | E04B 2/721 |
| 2002/0134042 | A1 * | 9/2002 | Bourque | E04B 1/003 52/712 |
| 2010/0307094 | A1 | 12/2010 | Spyrou | |
| 2012/0315081 | A1 | 12/2012 | Bouldin et al. | |
| 2013/0139465 | A1 | 6/2013 | Kuryk et al. | |
| 2014/0013701 | A1 | 1/2014 | Rodgers | |
| 2014/0215956 | A1 | 8/2014 | Smith et al. | |
| 2015/0299999 | A1 | 10/2015 | Koblasz et al. | |
| 2016/0153185 | A1 * | 6/2016 | Ter-Borch | E06B 1/02 52/204.1 |
| 2017/0044752 | A1 | 2/2017 | Higginbotham | |
| 2017/0298611 | A1 * | 10/2017 | Callahan | E04B 1/003 |
| 2017/0362816 | A1 | 12/2017 | Carbary et al. | |
| 2018/0283023 | A1 * | 10/2018 | Heady | E04G 23/0229 |
| 2019/0048577 | A1 * | 2/2019 | Studer | E04B 1/40 |
| 2019/0136512 | A1 * | 5/2019 | Naylor | E04B 1/66 |

* cited by examiner

DECK MOUNTING SYSTEM

CROSS-REFERENCE TO RELATED APPLICATIONS

This application is a Continuation-In-Part of U.S. patent application Ser. No. 15/676,269, filed Aug. 14, 2017 (pending), the disclosure of which is incorporated by reference herein.

FIELD OF THE INVENTION

This invention is related generally to a mounting system and particularly to a system for mounting an external structure to a building.

BACKGROUND OF THE INVENTION

Usually, external structures, such as decks or porches, are built onto a building, such as a house or other dwelling, as a separate structure from the actual building. That is, the deck structure has its own components and structures, including flooring and support structures, that are independent from the building. Those deck structural elements are then connected into some portion of the house or building for securing the deck with the building. The scenario of a structurally independent deck is a particular case when the structure is added onto the building sometime after the building has been completed. However, even when the deck is being built as part of the construction of the new building, the structure of the deck is still generally independent from the floor and wall structures of the building and generally will not share such elements with the house.

Depending on the design of the deck, porch or other external structure, its reliance upon the actual building for structural support will vary. For those structures that are built with posts or beams surrounding the entire structure and thus supporting the entire periphery of the deck, the connection to the house can be more superficial and not as robust. That is because the deck is built as a standalone structure and is merely attached to the building to present it as part of the building and to interface with a door or other opening for walking onto the deck.

However, other designs will support only the outer or side edges of the deck with posts. In such a case, the inside edges or other edges that are against the building rely upon structural support from the actual building. In those scenarios, it is much more important that the deck be connected to the house in a structurally sound way. Some current solutions for securing such a deck structure with a building still fall short in various ways.

Particularly, the structural components of the deck, such as a ledger board or other component that defines the edge of the deck that abuts against the house, are often just bolted into a counterpart component, such as a floor band board, of the house. This involves drilling properly located holes through the brick, siding or other veneer into the band board of the house. In other solutions, different anchors or brackets might be screwed or mounted to an outer surface of the house band board. The proper placement and alignment of any bolts and brackets can be an issue in such scenarios, particularly when the deck is added to the building after the building is complete. Furthermore, as might be appreciated, such mounting systems rely entirely upon the interface of the bolt, bracket or other structure with the band board for load bearing purposes. Accordingly, the load bearing features of the interface and the strength of such components are often the deciding factor in the overall load that the deck can handle.

There is thus a need for an improvement in the way that external weight bearing structures, such as decks and porches, are mounted with and supported by a building. There is further a need for an improvement in such a structural interface in both the scenario where the external structure is being built in conjunction with the supporting building, and when the external structure is later added to the supporting building. These and other needs and issues are addressed by the invention as disclosed herein.

SUMMARY OF THE INVENTION

A mounting system for mounting an external structure with a building includes and anchor frame for mounting with structural elements of a building and a bracket for coupling with the external structure. In some embodiments the anchor frame is used alone and in other embodiments the anchor frame and bracket are used. The anchor frame includes a plate element with a planar portion configured for mounting against a board of a building, such as a band board. Anchor elements extend from sides of the plate element and are configured for mounting against another board of a building, such as a floor joist. The bracket couples with the anchor frame and first and second face portions that are spaced apart. The first face portion is configured for mounting also against a board, opposite the plate element, and a bolt element couples the plate element and face portion together through the first board. The second face portion is configured for mounting with an external structure, such as a deck, thereby tying the external structure in with elements of the building.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serves to explain the invention.

DETAILED DESCRIPTION OF THE INVENTION

The present invention is directed to a mounting system for mounting an external structure with a building. In one particular use of the invention, the mounting system is suitable for mounting an external deck, porch or other structure onto a residential building, such as a house, or other building. The inventive mounting system incorporates a plurality of elements which cooperate to both anchor an external structure with internal structural elements of a building and also to provide a convenient platform for securing an external structure, such as a deck, once the mounting system is in place. The inventive mounting system may be utilized with structures that have both brick and siding veneers or other outer surfaces or veneers. The mounting system is installed, in one embodiment, at a floor interface of a building. More specifically, the mounting system is configured for mounting with structural floor elements of a building, such as band boards and floor joists. As described and illustrated herein, embodiments of the invention will be discussed with respect to mounting a deck structure to a house; however, the invention may be used with any building having certain structural elements to secure other external structures. Accordingly, the invention is not limited by the discussed exemplary usage.

The present invention provides a strong and efficient mounting system for mounting external structures to and through a building and provides an efficient installation method wherein elements of a mounting system may be put into place on and within the building and the external structure and other elements of a mounting system may be added at a later time. Features of the mounting system provide for positive location on the exterior of a building for installers. Furthermore, as noted, the mounting system is adaptable for use with a number of building exterior veneers and building structures whether having wooden framed walls, poured concrete foundation walls, or some other construction.

Figure 1:
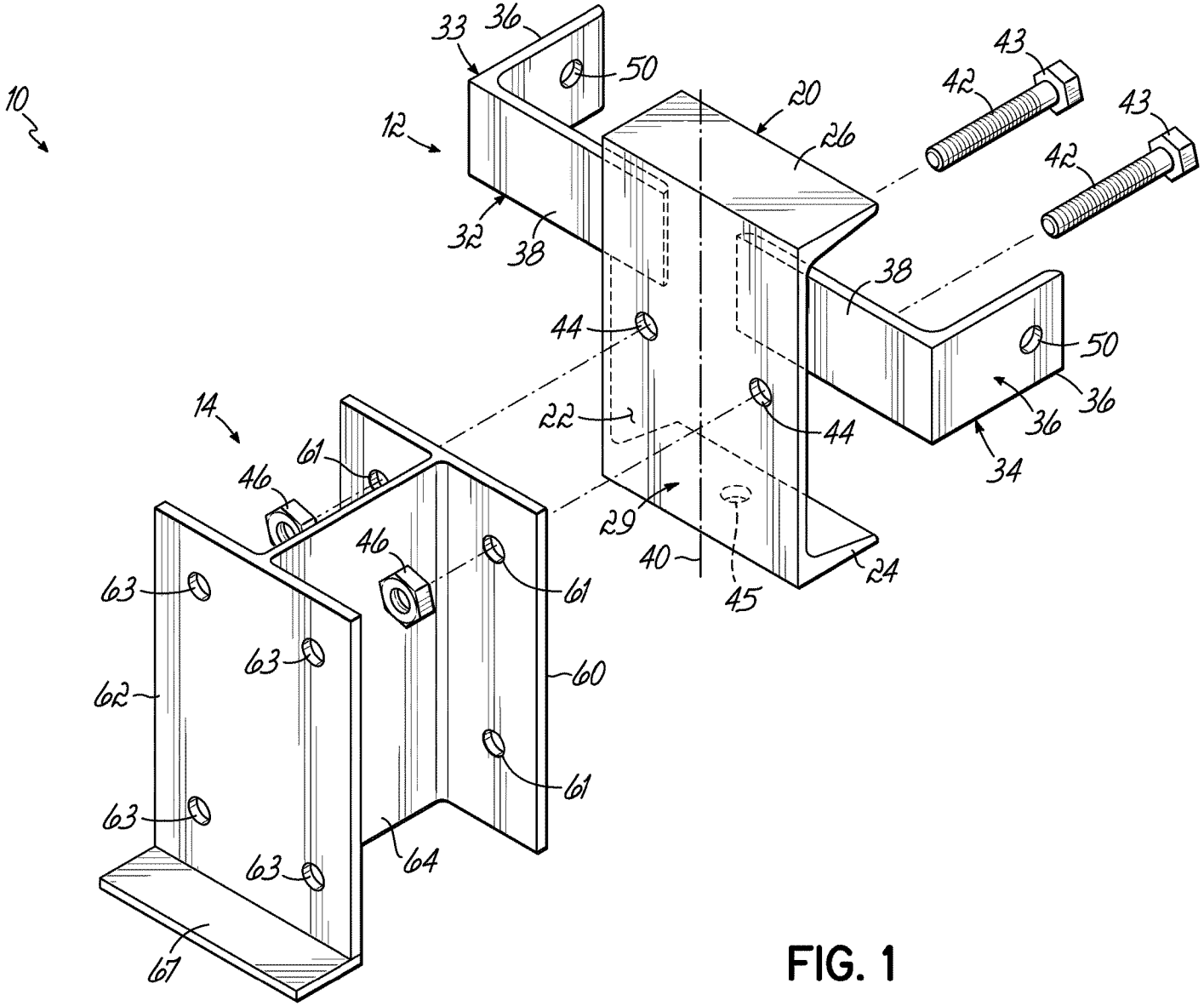
FIG. 1 is a perspective view of a deck mounting system in accordance with an embodiment of the invention.

FIG. 1 is an exploded perspective view of the mounting system 10 of the invention for mounting an external structure with the building. The mounting system 10 includes an anchor frame 12 and a bracket 14 that may be secured with the anchor frame 12 for certain installations as discussed herein. That is, for some installations, the anchor frame 12 may be utilized alone and for other installations, the anchor frame is utilized in combination with the bracket.

Figure 2A:
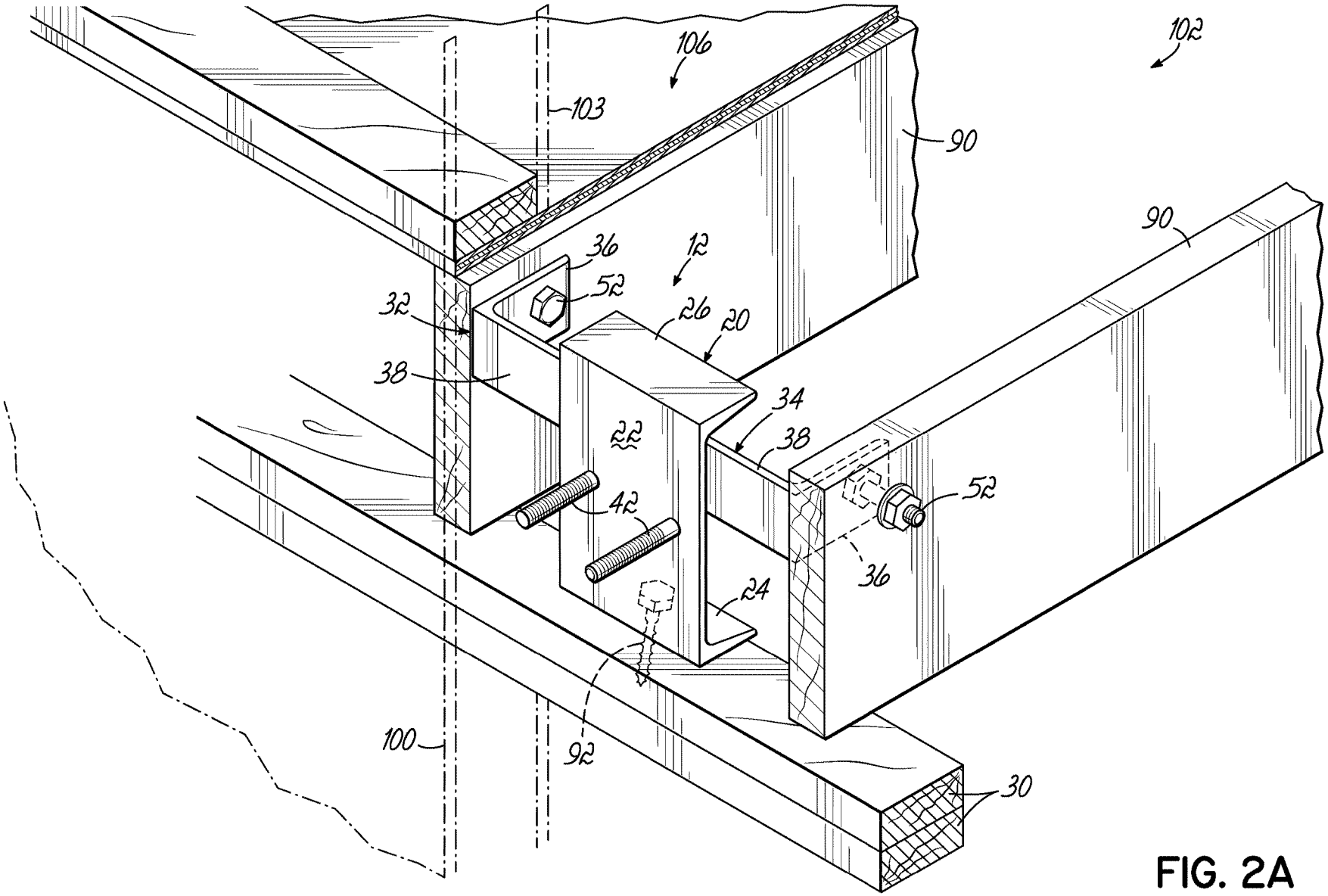
FIG. 2A is a perspective view of a component of a deck mounting system of FIG. 1 shown installed with structural elements.
Figure 2B:
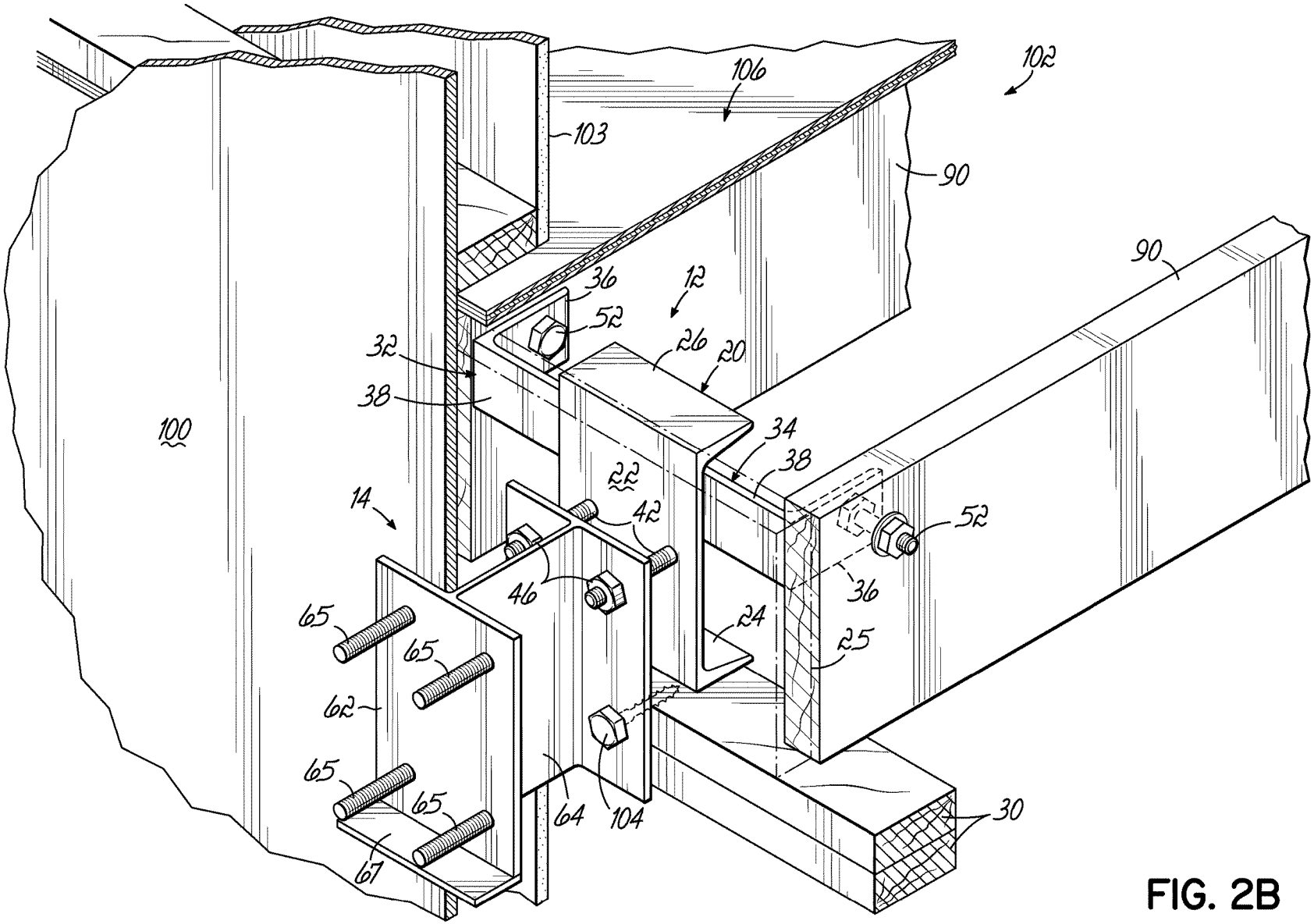
FIG. 2B is another perspective view of components of a deck mounting system of FIG. 1 shown installed with structural elements.
Figure 2C:
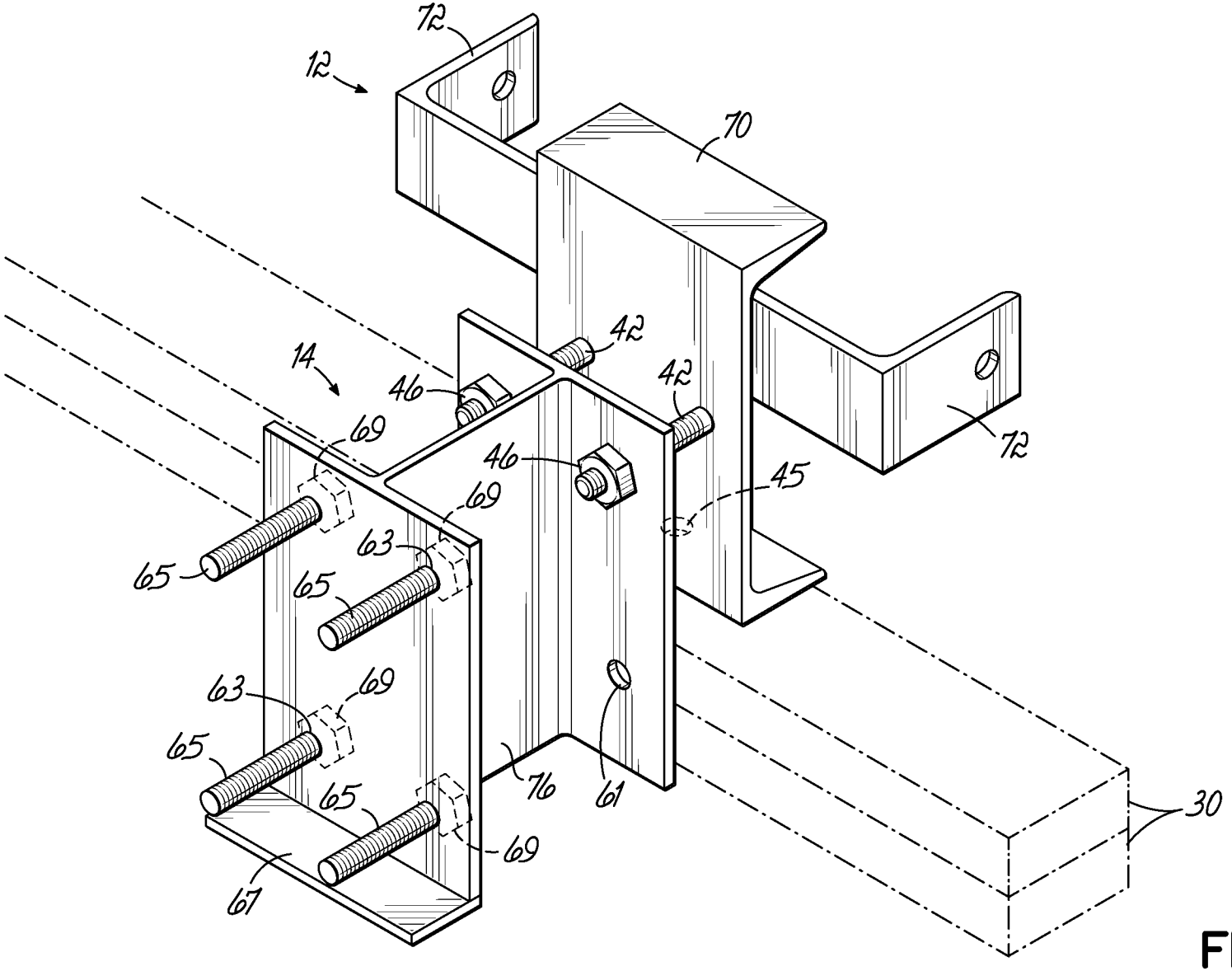
FIG. 2C a close up perspective view of components of a deck mounting system of FIG. 1 shown installed together.
Figure 2D:
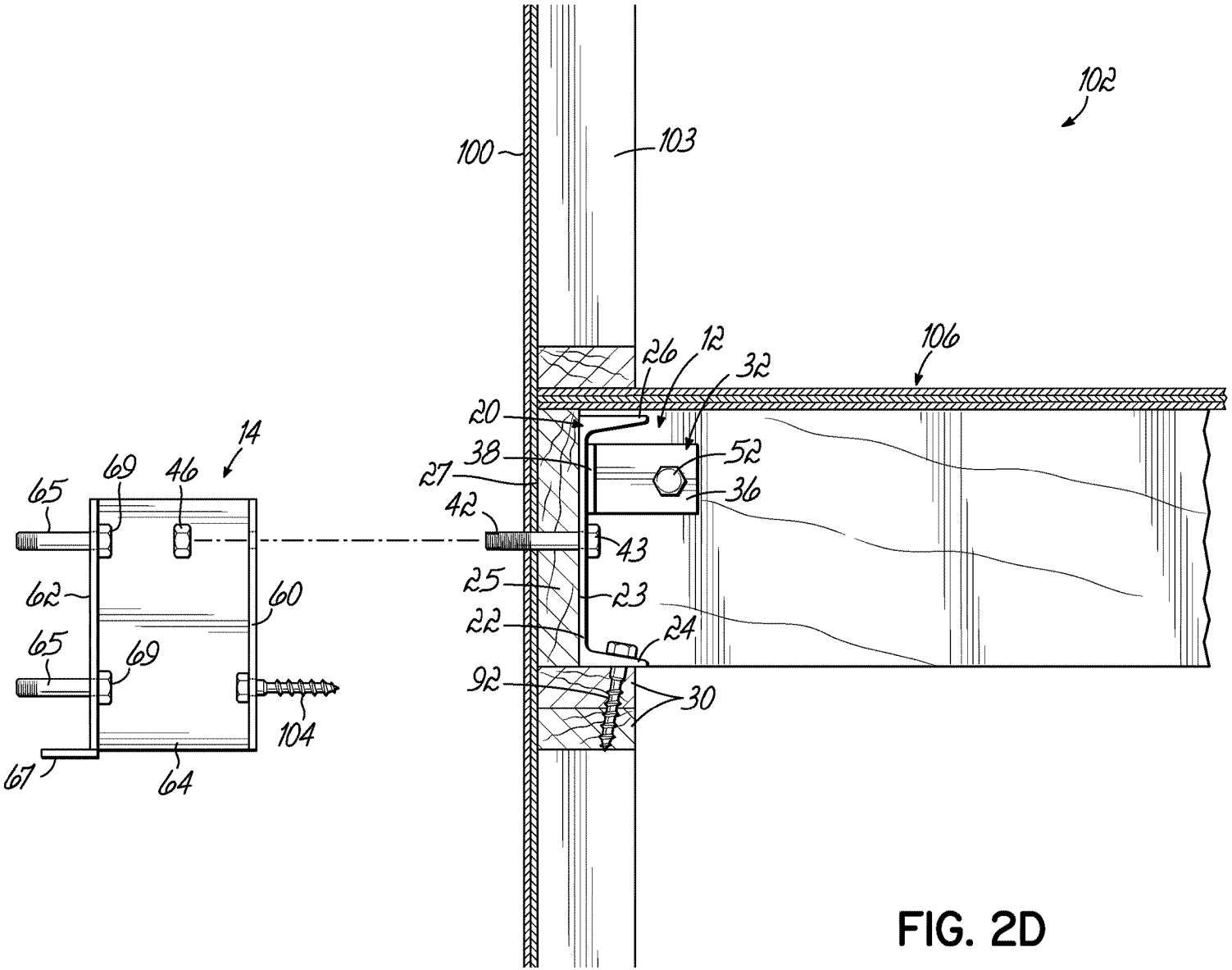
FIG. 2D a side view, in partial cross-section, of components of a deck mounting system of FIG. 1 shown installed with structural elements.

The anchor frame 12 is configured for mounting with structural elements of a building, such as floor elements, including band boards and floor joists as illustrated herein. The anchor frame includes a plate element 20 that has a planar portion 22 that is configured from mounting against a structural element, such as a band board. The planar portion 22 lies against a face 23 of the band board (see FIG. 2D). More specifically, the plate element creates a planar surface 29 that lies against a face 23 of the board. As understood by a person of ordinary skill in the art, within the flooring of a particular building, band boards are incorporated around the periphery of a floor, while floor joists span from the band boards, generally perpendicular to the band boards, and provide a platform for supporting a floor surface. Such band boards are presented proximate the exterior wall of a building as shown in FIGS. 2D-5. The planar portion 22 is configured for lying up against an interior face surface 23 of a band board when the anchor frame is installed as shown in FIG. 2D. In accordance with one embodiment of the invention, the anchor frame 212 is formed of a suitably rigid material such as steel. Although the anchor frame is discussed herein for use with a band board and perpendicular floor joist, other boards in a building that are suitably oriented might be used with the anchor frame.

For example, in the illustrated embodiment as shown in FIG. 1, the plate element 20 of the anchor frame 12 may be formed with a length of steel channel stock. In one embodiment of the invention, the plate element 20 includes one or more lip portions 24, 26 that extend generally perpendicular to the planar portion 22. For example, if the plate element 22 is formed from channel stock, the sides of the channel might form the noted lip portions 24, 26. In the illustrated embodiment, the bottom lip portion 24 extends generally perpendicular to the planar portion 22 from a bottom end of that planar portion as illustration in FIG. 1. As shown in other figures herein, including FIG. 2D, the lip portion is configured for mounting against a structural element of a building, such as one or more top plates 30 in the wall of a building for further supporting and securing the anchor frame.

The anchor frame further includes at least one anchor element and preferably a plurality of anchor elements 32, 34 that extend from the side of the planar portion 22. The one or more anchor elements 32, 34 are configured from mounting against another building structural element, such as a floor joist that is oriented perpendicular to the band board. As utilized herein, the terms such as "band board" and "joist" or "floor joists" are used for the purposes of noting common floor related structural elements of a building wherein a band board is positioned at a periphery of a floor and would be exposed to an outer wall of a building and the floor joists extend from the band board and are oriented generally perpendicular to the band board. However, the invention is not limited to a particular structural element or the names as used herein and the mounting system might be incorporated with other similarly situated, yet differently named boards and other structural elements of a building.

The anchor elements 32, 34 extend from a side of the planar portion 22 a suitable distance on opposite sides for mounting against adjacent joists or other elements that are oriented perpendicular to the band board. As such, each anchor element 32, 34 includes an anchor portion 36 that is oriented generally perpendicular to the plane of the planar portion 22 of the anchor frame 20. For proper positioning and coupling of the anchor portions 36 with plate element 20, the anchor elements 32, 34 may also include suitable span portions 38 that space the respective anchor portions 36 from the center line 40 of the anchor frame. For example, in a typical residential building, the floor joists may be spaced at 16 inches on center and thus the anchor elements 32, 34 are configured for positioning anchor portions 36 at a suitable distance for mounting against a face or face surface of a floor joist.

When installed, the anchor frame 12 is secured with the various structural elements of the building. To that end, bolt elements may be utilized as illustrated in various of the Figures herein. For example, the mounting system may include one or more bolt elements 42 that are coupled or secured with the anchor frame. In the illustrated embodiment, the bolt elements extend through the planar portion 22 and particularly extend through holes or apertures 44 formed through the plate element 20 of the anchor frame. The bolt elements extend from the planar portion 22 of the plate element 20 for securing the plate element with an external structure such as a band board. The bolt elements 42 may be threaded as illustrated in FIG. 1 and may include appropriate threaded nuts 46 that are coupled with the bolt elements 42 for proper securement. The bolt elements may be separate from the anchor frame or may be secured to the anchor frame, such as with a weld. If welded, the bolt elements may be welded on one side of the plate element and extend through apertures 44 or may be welded or secured on the other side and thus not require any apertures.

In addition to securing the plate element 20 with a building structural element, the bolt elements 42 may also secure the anchor frame 12 with bracket 14 as illustrated and discussed herein. When the plate element is secured to a band board, the anchor portions 36 of anchor elements 32, 34 are also appropriately secured with respect to structural elements, such as floor joists. To that end, the anchor elements have a planar surface 33 as shown and include holes or apertures 50 formed therein for receiving other bolt elements, such as a bolts 52, as illustrated in FIGS. 2A, 82, and 2D. As illustrated, the planar surfaces 33 fit up against the flat surfaces of a joist or other board. The bolts 52 could be pass through threaded bolts as shown or might be lag bolts. In some embodiments, and depending on the installation, the lower lip portion 24 may include an aperture 45 to receive a lag bolt 92 to further secure the anchor frame 12. Depending upon the materials and the structural elements of the building with which the mounting system of the invention is used, the bolt elements may take a number of forms, such as traditional threaded bolts 42 and nuts which are used to couple metal elements of the mounting system together through one or more structural elements or threaded lag bolts as illustrated herein that may be screwed into suitable wooden structural elements as illustrated. Accordingly, the present invention is not limited to a particular construction of the bolt element that is used to secure the mounting system with or through certain of the structural elements of a building.

Referring again to FIG. 1, the mounting system, in certain installations, includes bracket 14 for coupling with anchor frame 12. Bracket 14 is formed with a suitably strong material such as steel and includes a first plate or face portion 60 for coupling with plate element 20 of the anchor frame 12. More specifically, as illustrated in the figures, face portion 60 is generally planar and is configured for mounting against the face surface 27 of a band board 25 of a building, opposite plate element 20, and specifically opposite the planar portion 22 of that plate element. As installed, the bracket face portion abuts against an outer face surface 27 of band board 25 (see FIG. 2D for example).

Bracket 14 further includes a second plate or face portion 62 that is spaced from the first face portion 60. The second face portion 62 is configured for mounting with an external structure, such as elements of an external deck structure as described herein. Coupling or connecting the first face portion 60 and second face portion 62 is a web or span portion 64 of the bracket that spaces the face portions from each other. As noted herein, the mounting system of the invention might be utilized with a building that includes a veneer structure, such as brick or some other material. As such, any external structure, such as a deck structure would be mounted spaced from the outside surface of structural elements of a building to address other veneer materials. To accommodate brick and other materials as illustrated in the Figures, the span portion 64 will provide a spacing between the face portions 60, 62 that will accommodate such materials. As such, the span portion 64 may have various suitable dimensions to achieve the spacing and the invention is not limited to a particular span. The face portions are secured with respective elements using bolt elements. The face portions 60, 62 of the bracket may include one or more respective apertures 61, 63 for accommodating bolt elements to secure the bracket 14 to the anchor frame 12 as well as to secure the bracket to structural elements of the building. Apertures 63 are used to connect structural elements of the external structure (e.g. a deck) with the mounting system. Such bolt elements 65 as used with face portion 62 may be loose or may be fixed with the bracket, such as by welding. As noted with anchor frame, if the bolts 65 are welded they might be welded on one side and pass through apertures 63 or might be welded to the other side and not have to pass through apertures (see FIG. 2B-2D). As shown in FIG. 1, certain of the apertures 61 in face portion 60 may receive the bolt elements 42 for coupling the anchor frame 12 and bracket 14. Other apertures 61 of face portion 60 and apertures 63 of face portion 62 may accommodate other bolt elements. For example, lag bolts might be screwed into suitable structural elements of the building or external structure as described.

In accordance with one embodiment of the invention, the various planar components and portions of the steel anchor frame 12 and bracket 14 might be welded together with separate steel plates to form the invention. In another embodiment, the anchor frame 12 and bracket 14 may be fabricated from steel elements, such as channel elements, angle elements, and H-beam elements. Referring to FIG. 2C the anchor frame 12 might be formed by a steel channel element 70 such as a C-channel element. Such a C-channel element can be used to provide the planar portions 22 and lip portions 24, 26 of the anchor frame 12 as disclosed. Angle elements 72 may then be welded appropriately to C-channel elements 70 at interfaces to form the anchor frame and anchor elements. The bolt elements 42 extend through apertures 44 in the C-channel element. In one embodiment, the bolt heads 43 of the bolt elements may be appropriately welded with one side of the planar portion 22 formed in order to project forward through apertures for engaging with a band board and bracket 14 and to secure the bolt elements as part of anchor element 12.

For forming bracket 14, an H-beam element 76 might be implemented to provide first and second face portions 60, 62 and a spanning portion 64 as discussed herein. Appropriate holes or apertures 61, 63 are formed in the H-beam element 76 for receiving bolt elements 42, 65 or one or more lag bolts 104. As illustrated in FIG. 2C, threaded bolts 65 might be utilized in the second face portion 62 and the heads 69 of the bolts 65 might be welded to the second face portion 62 to present bolt elements to be secured with structural elements of an external structure, such as structural elements of a deck. As noted, one or more apertures 61 might also be formed below those apertures receiving the bolts 42 for receiving other bolt elements, such as a lag bolts to further secure the anchor frame with structural elements of a building. In that way, the bracket is secured both to the anchor frame and then separately to a structural element of the building. A shelf 67 is formed on face portion 62. The shelf might be formed by welding a rectangle steel section to the lower edge of face portion 62 of the bracket. As noted herein, shelf 67 provides support for a ledger board or other element of the deck.

In one exemplary embodiment of the invention, the plate element 20 of the anchor frame is approximately 6 inches by 9 inches (6"×9"). The anchor elements span to either side to form a total span of approximately 14¼" and are approximately 2½" high. The face portions 60, 62 are also approximately 6"×9" and the span portion 64 provides a span distance between the face portions of approximately 6". The thickness of the components 20, 32, 34, 60, 62, 64 of the anchor frame and bracket may be approximately ¼" thick. Of course, the invention is not limited to specific dimensions of the various components.

Referring now to FIG. 2A, the anchor frame 12 is illustrated mounted with various structural elements of a building to secure the anchor frame with the building. More specifically, structural elements such as floor joists 90 are shown positioned on top plates 30 that are positioned at a wall of the building. The floor joists 90 span out for forming the floor sub-structure. In FIG. 2A, the band board 25 is shown removed for illustrating the anchor frame 12 in position. However, shown in FIG. 2D, the band board would generally be positioned against the planar portion 22 of the plate element 20 of the anchor frame. As shown in FIG. 2A, plate element 20 includes lip portion 24 that rests on the top plates 30 at installation. The anchor elements 32, 34 span outwardly from the plate element 20 for coupling with the floor joists 90. For some installations, wherein wooden top plates 30 are part of the structural elements of the building, a bolt element such as lag bolt 92 is screwed into the top plates through aperture 45 in the anchor frame 12 (see FIG. 1). In other installations, such as those shown in FIGS. 3B and 4B, a lag bolt 92 might not be utilized and the lip portion 24 would simply rest upon a suitable building structural element such as a top plate or concrete foundation.

To secure the anchor elements 32, 34, bolts 52 are used and are passed through apertures 50 formed in the anchor elements and may be passed through the anchor board, such as the floor joist. Specifically, the anchor elements include anchor portions 36 that are oriented generally perpendicular to the planar portion 22 of plate element 20. As such, when the plate element 20 and surface 29 is oriented against the interior face 23 of band board 25, the appropriately spaced anchor portions 36 of the anchor elements will lie against a face surface of the floor joists 90 (see FIG. 2A, 2B, 2D). The anchor portions may then be appropriately secured with bolt elements, such as bolts 52. In that way, as shown in FIG. 2A, the anchor frame may be secured with the structural elements inside of a building and behind board 25. As will be appreciated, depending upon the dimensions of the anchor frame as well as the placement of the various bolt elements 42, in order to place anchor frame against band board 25, holes will have to be marked and drilled or otherwise made in the band board 25 so that the bolt elements 42 may pass therethrough. This would have to be done before seating the anchor frame, particularly in those scenarios where the bolts 42 are welded to the anchor frame. Furthermore, there might be other external layers 100 on the outside of the band board 25 and on the outside of the building, and thus holes would have to be formed therethrough as well (see FIG. 2D). As may be appreciated, a template might be utilized for drilling the appropriate holes through the band board 25 and other layers 100 so that the anchor frame may be properly mounted against the band board and floor joists.

Figure 5:
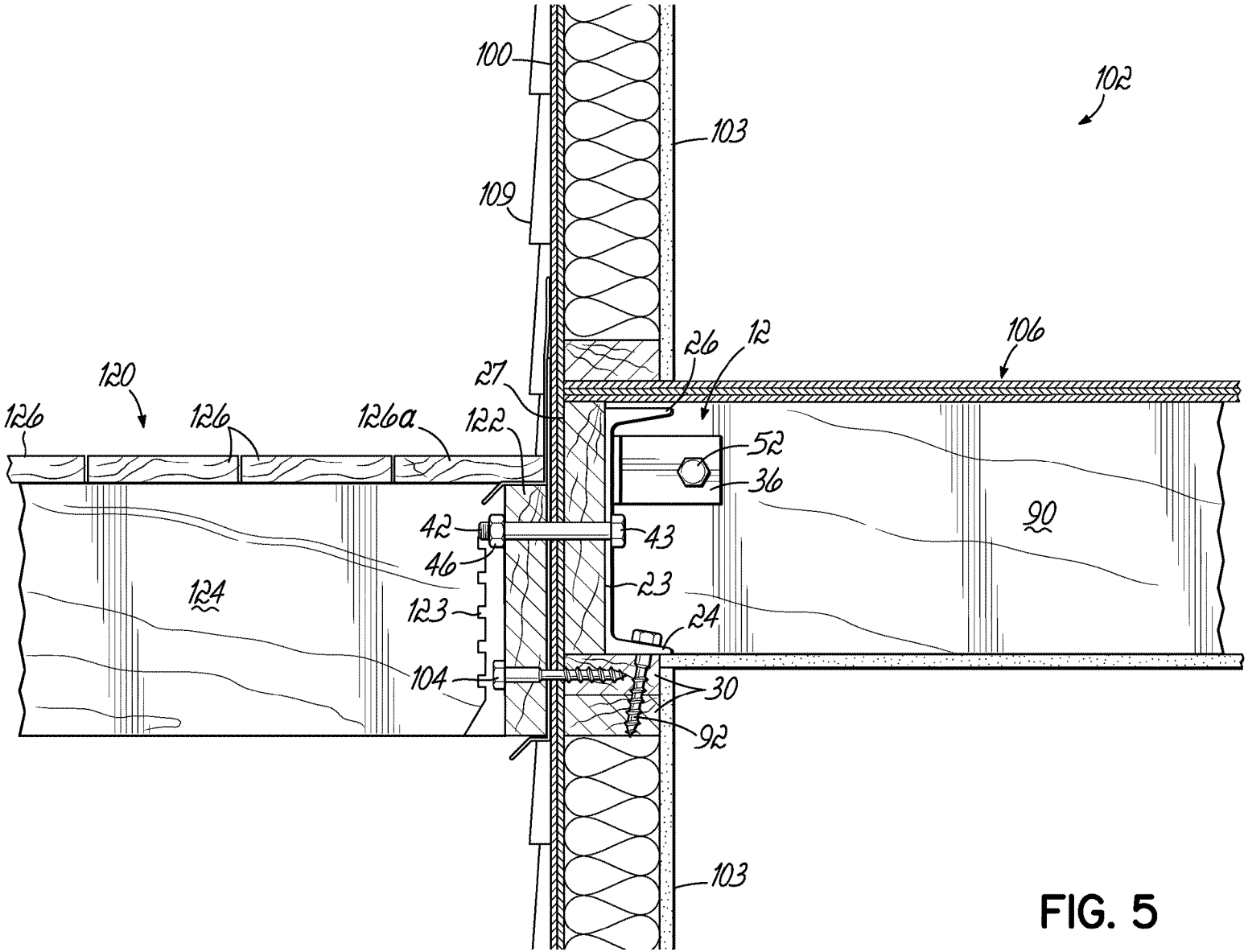
FIG. 5 is a side view, in partial cross-section, of a deck mounting system of the invention in another building installation.

As illustrated herein, in some installation scenarios, the mounting system may only have to utilize the anchor frame 12 for securing an external structure, such as a deck. For example, the configuration as illustrated in FIG. 5 only utilizes anchor frame 12. However, for various other installations, the mounting system utilizes the bracket 14 that couples with the anchor frame 12 for the mounting system. Referring to FIGS. 2B and 2D, once the anchor frame has been installed, the various bolt elements 42 are presented at an outer surface of the board 25 and building 102. Bracket 14 may then be secured with the anchor frame 12 and the band board 25 through bolt elements 42 and other bolt elements 104. Specifically, the first face portion 60 is configured for being mounted against surface 27 of band board 25 (and intervening layers 100) as shown in FIG. 2D. As such, as illustrated in FIG. 2B, when the bracket is mounted, the first face portion is positioned opposite the plate element 20 and specifically opposite the planar portion 23 of the plate element and on the other side of the board 25. As discussed herein, reference to mounting against the band board, against a floor joist, or against some other element does not require that certain portions of the mounting system actually contact such band boards, floor joists, or other structural elements. That is, there may be other layers, such as insulating layers, waterproof layers, and other suitable materials or layers against those building structural elements and thus between the structural elements and components of the mounting system. As such, when a portion or element of the mounting system is mounted against such a structural element, it includes a scenario of mounting against other additional layers that overlie a face surface of the structural element. Referring to FIG. 2D, the first face portion 60 of the bracket mounts against band board 25 through the additional layers 100 as noted. To secure bracket 14 with anchor frame 12, the bolt elements 42 extend through appropriate apertures 61 in the first face portion as shown in FIGS. 2B and 2C, and the bolt elements are secured with the appropriate nuts 46. Accordingly, the mounting system of the invention captures the board 25 between elements of the mounting system to tie the system into the building structure. As such, load of the deck or other structure is transferred to the entire board and not just to anchors or bolts extending into the board. Furthermore, as discussed herein, the mounting system also ties in directly to the floor joists for further load bearing and support.

In one embodiment of the invention the bolt elements 42 extend from or through the planar portion of the plate element 20 generally in the middle of the plate element as shown in FIG. 2D. Depending upon the positioning of the apertures 61, the first face portion 60 and bracket 14 may be offset slightly below the position of the anchor frame 12 in the building. As such, the bracket 14 is positioned vertically lower on the outside of building 102 than the anchor frame is inside the building. Other apertures 61, formed within the first face portion 60 at positions below those apertures 61 that receive the bolt elements 42, align with other structural elements, such as the top plates 30 inside the building (see FIG. 2D). To that end, to further secure bracket 14 with the structural elements of the building and independently of anchor frame 12, bolt elements such as lag bolts 104 may be screwed through the lower apertures 61 in the first face portion and screwed into the top plates 30 as shown in FIG. 2B. Generally, the apertures 61 within bracket 14 and aperture 45 within the lip portion 24 are positioned so that the lag bolts 104 do not interfere with and lag bolts 92 securing the anchor frame with top plates 30 as illustrated in FIGS. 2A and 2D. Once secured, the bracket 14 is thus tied to and supported by the structural elements of the building including the band board 25 and floor joists 90.

Once the bracket 14 is secured with anchor frame 12 and thereby with structural elements of the building, the second face portion 62 is exposed and spaced from the first face portion and presents a plurality of other bolt elements 65 externally on the building. Those bolt elements 65 are then secured to structural elements of an external structure, such as the ledger board or other similar board or element of a deck structure as illustrated herein. Those bolt elements 65 may be appropriately threaded and secured with threaded nuts similar to the bolt elements 42 and nuts 46. As noted, the bolt elements might be fixed to the bracket and the heads 69 or other portions of the of the bolt elements 65 might be welded to the second face portion 62.

The mounting system may be positioned along the side of a building at various positions as dictated by the dimension of the deck or other external structure. That is, several mounting systems of the invention will be used to support a structure in most installations. For example, a mounting system 10 as disclosed might be positioned every 2 to 5 feet along a deck for proper support.

FIGS. 3A-3B, 4A-4B, and 5 illustrate several installation scenarios for the mounting system of the invention. As noted, the mounting system may be utilized with walls that are essentially wood frame walls, as well as poured concrete foundation walls and may be utilized with buildings that have veneer structure such as brick or siding. Once one or more of the mounting systems are installed, the various structural elements of an external structure, such as a deck may be mounted to the exposed elements and portions of the mounting system to secure the external structure with the building.

Figure 3A:
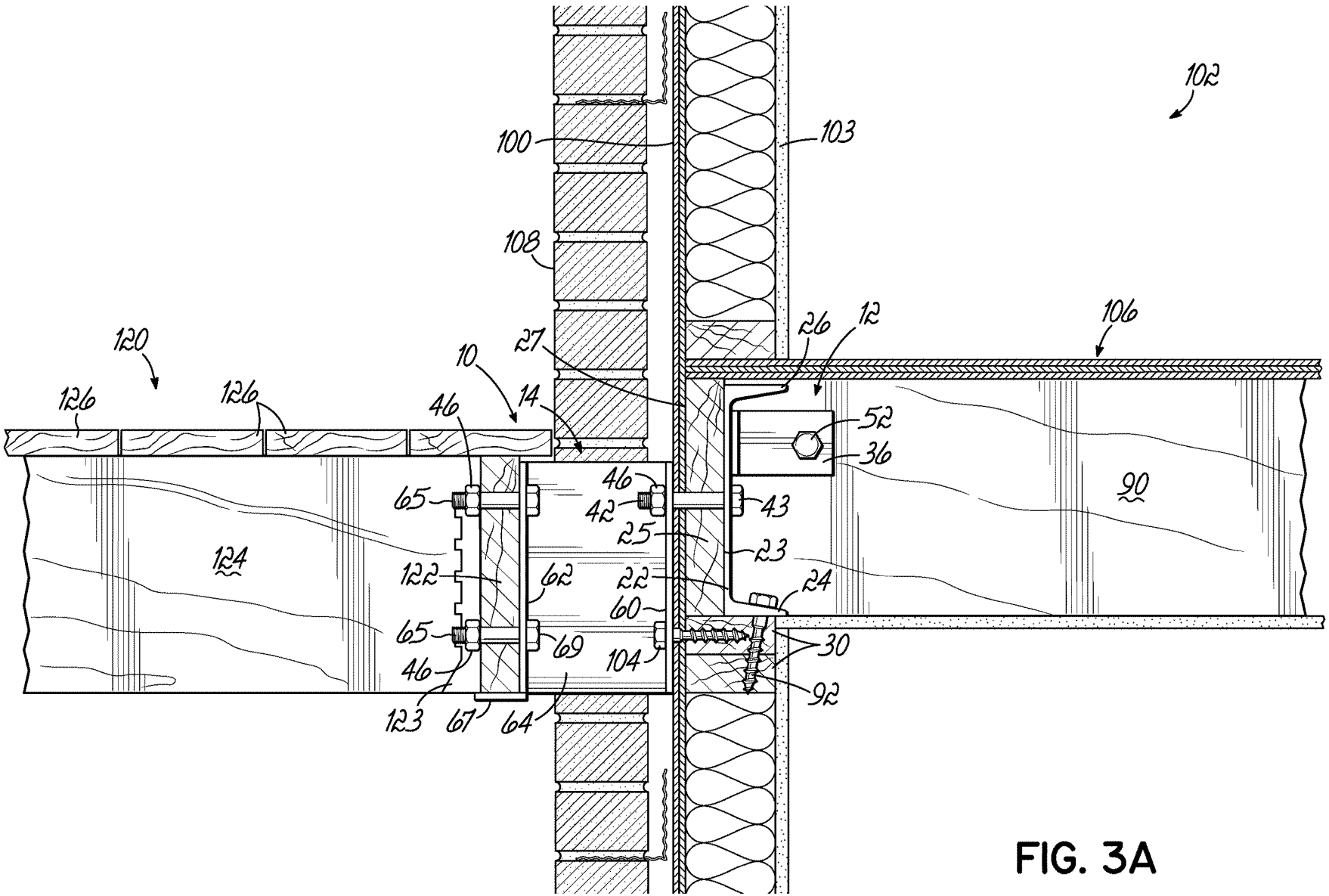
FIG. 3A is a side view, in partial cross-section, of a deck mounting system of the invention in a building installation.

Referring to FIG. 3A, the mounting system 10 of the invention as illustrated used with the building 102. The floor structural elements 106 are mounted on a wood frame wall 103 and the building includes a brick veneer 108. To that end, the anchor frame 12 is secured to band board 25 and to floor joists 90 as well as to top plates 30 with the appropriate bolt elements 42, 52, and 92. Bracket 14 is then secured against band board 25 and with anchor frame 12 through bolts 42 and is secured with structural elements of the building, such as top plates 30, through one or more bolt elements 104. The bracket 14 then presents bolt elements 65 at an outside surface of the building. Generally, the mounting system is installed while the interior band board surface and floor joists are exposed. Also, the installation is generally before the outer veneer is installed on the building. As such, brackets 14 are exposed. The brick veneer may then be installed or applied. The bracket 14, and particularly the span portion 64, provides for suitable spacing for building the brick veneer 108 and bricks from that veneer may be mounted on either side of the span portion 64 between the two face portions 60, 62 of the bracket. As such, a significant portion of the bracket is also visually hidden after final construction while still providing a strong securement of a deck to the building 102.

An external structure, such as a deck 120 may then be mounted to building 102 in accordance with the invention. More specifically, an appropriate external structural element, such as a ledger board 122 of the deck 120 is secured to bracket 14 with bolt elements 65. Appropriate holes are formed in the deck ledger board 122 to receive bolt elements. Such holes are drilled at spacing intervals along the ledger board according to the position of the exposed brackets. In accordance with another feature of the invention, the bracket 14 includes a shelf 67 which receives the lower edge of the ledger board 122 and further provides bracket support for the band board in addition to the bolt elements 65. Ledger board 122 may then be appropriately coupled with floor joists 124 to then receive floor boards 126 of the deck 120. In that way, the deck 120 or other external structures are secured directly to internal structural elements of the building, including the band board 25 and floor joists 90 to provide a robust securement and mounting of the external deck 120.

Figure 3B:
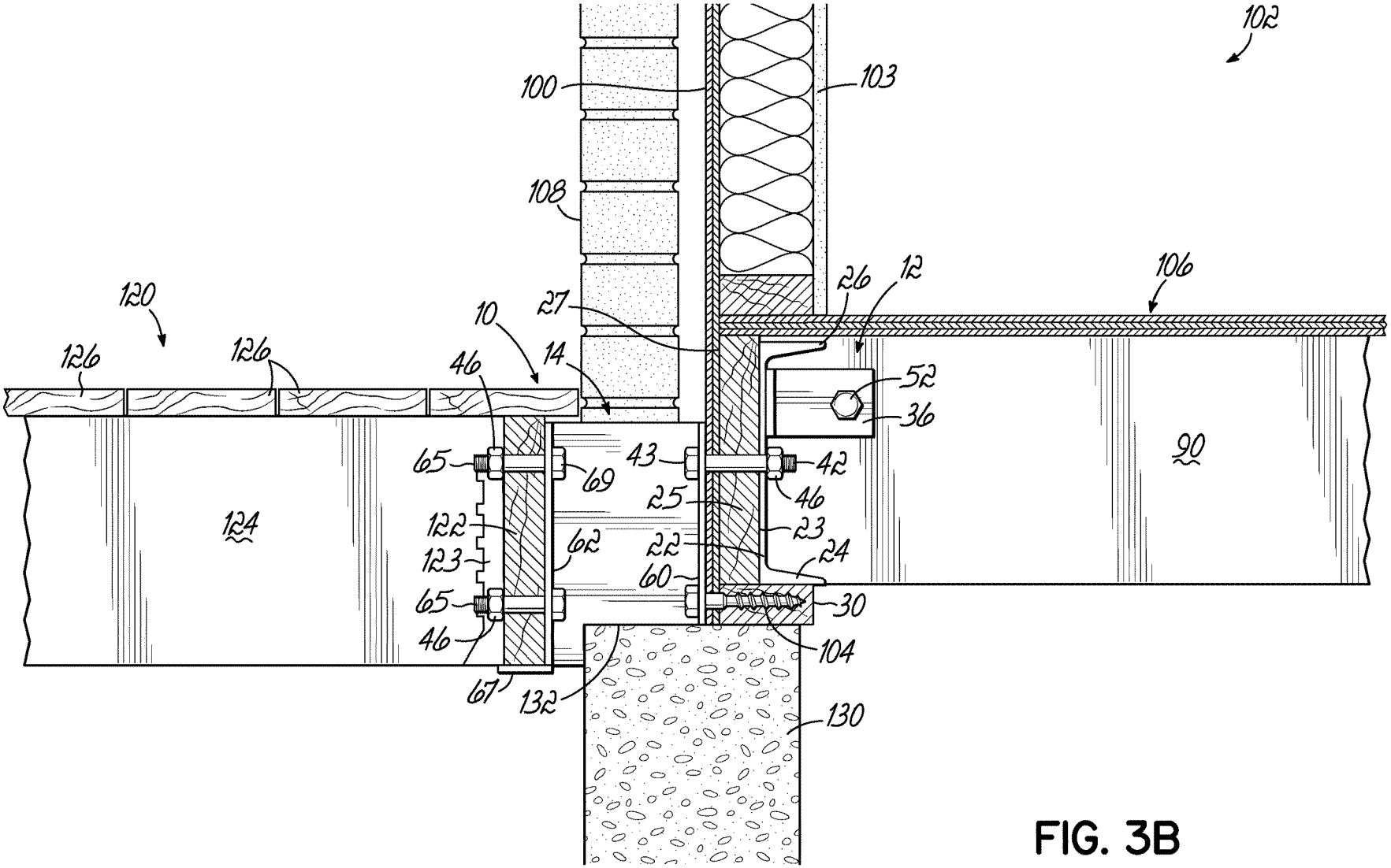
FIG. 3B is a side view, in partial cross-section, of a deck mounting system of the invention in another building installation

FIG. 3B provides a somewhat similar building scenario of a building 102 including a brick veneer 108 and an external deck 120 and, as such, like numerals are utilized. However, the building 102 includes a concrete foundation wall rather than a wood stud wall. As such, the anchor frame is mounted to sit on top of the foundation wall. Referring to FIG. 3B, the anchor frame 12 is secured in a similar fashion to the scenario of FIG. 3A, as discussed herein. However, in such scenarios, the number of top plates 30 may limit the thickness of wood structural elements above the foundation wall 130. As such, anchor frame 12 may only rest on the face plate or plates 30 and may not be specifically secured thereto, such as with bolt element 92. However, bracket 14 is similarly secured to the anchor frame and building 102 and to structural elements of deck 120.

Figure 1A:
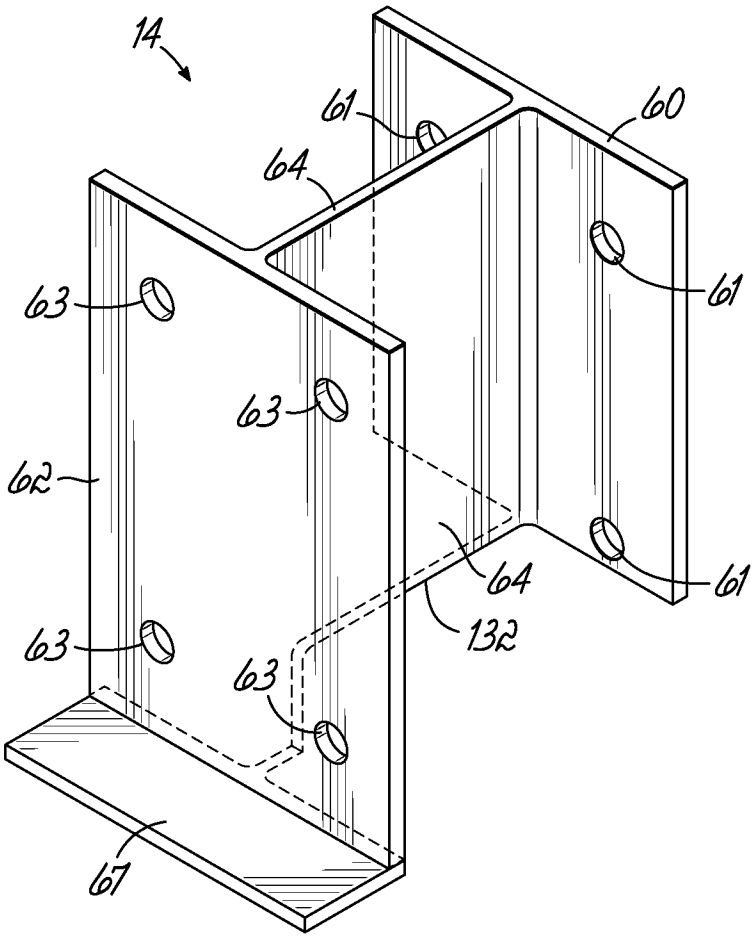
FIG. 1A is a perspective view of a component of a deck mounting system in accordance with another embodiment of the invention.

In the embodiment of FIG. 3B, due to the vertical offset of bracket 14 from the anchor frame 12 and depending upon the height of any top plates 30, bracket 14 may include a notch 132 forward therein for accommodating the foundation wall 130. In such a scenario, the brick veneer 108 rests on wall 130. FIG. 1A illustrates a version of bracket 14 that includes the notch 132. Of course, if suitable vertical spacing is provided by top plates 30 to space anchor frame sufficiently above the foundation wall 130, it may not be necessary to use a notched bracket. As illustrated, the notch may generally affect the size of face portion 60 relative to face portion 62. However, the bracket of 14 and anchor frame operate the same as disclosed herein.

Figure 4A:
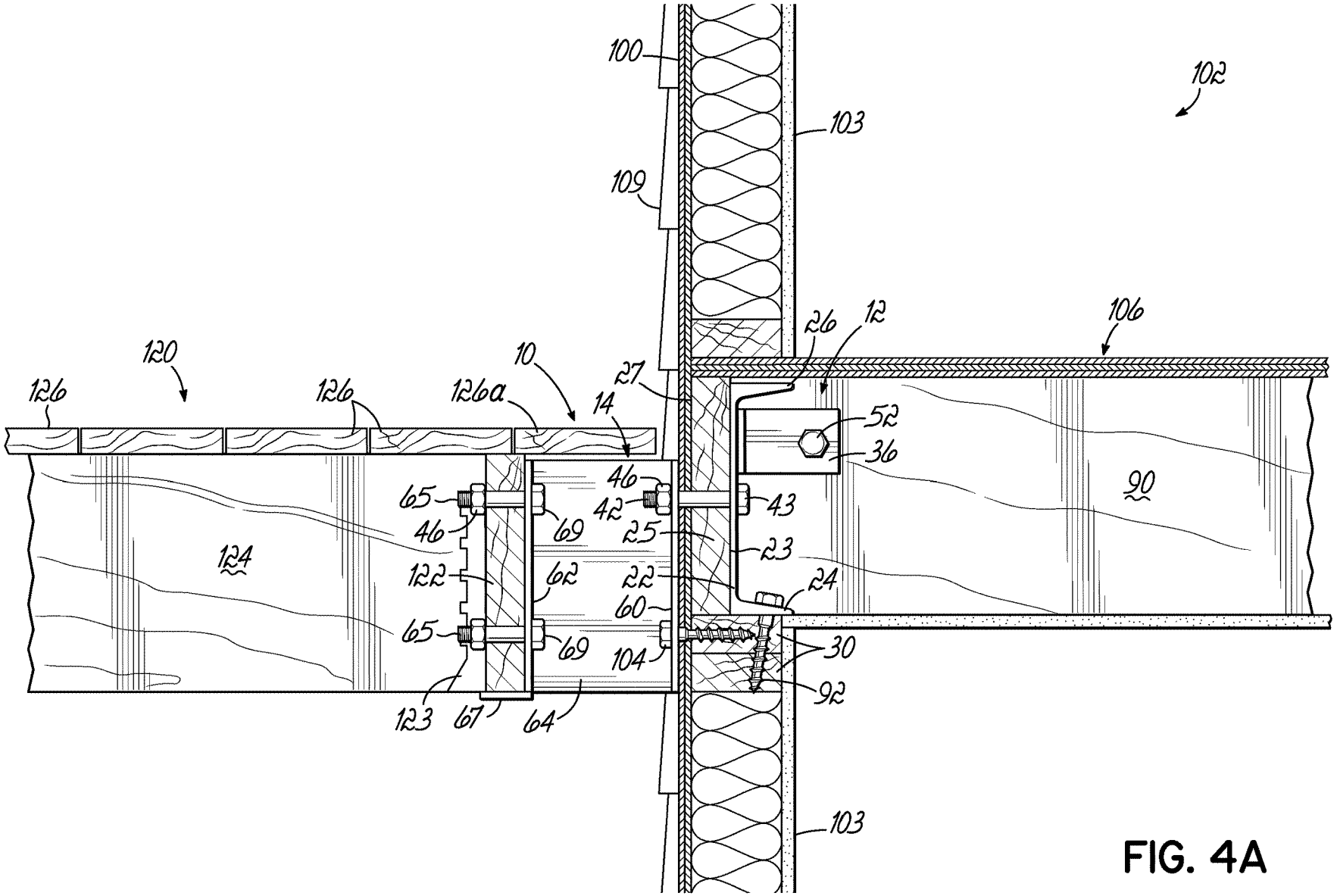
FIG. 4A is a side view, in partial cross-section, of a deck mounting system of the invention in another building installation

Turning to FIG. 4A, the use of the mounting system of the invention on a building 102 that incorporates siding 109 rather than a brick veneer is illustrated. The building 102 includes a wood stud wall 103 similar to the scenario of FIG. 3A and the anchor frame is appropriately secured both to the band board 25, floor joists 90, and top plates 30 of the stud wall 103. Similarly, bracket 14 is secured in a similar fashion as illustrated in FIG. 3A. Because of the use of siding 109, which has a thinner profile than a brick wall, a spacing is provided by the bracket that is associated with the span portion 64 of bracket 14. To that end, floor boards 126 of the deck 120 may span that distance between the two face portions 60, 62 of the bracket. Specifically, floor board 126*a* is illustrated spanning that distance. For support of that floor board, blocking structures (not shown) might be utilized on the external surface of a building 102 between sequential mounting systems in order to provide support for such boards 126*a* that span the distance provided by the bracket.

Figure 4B:
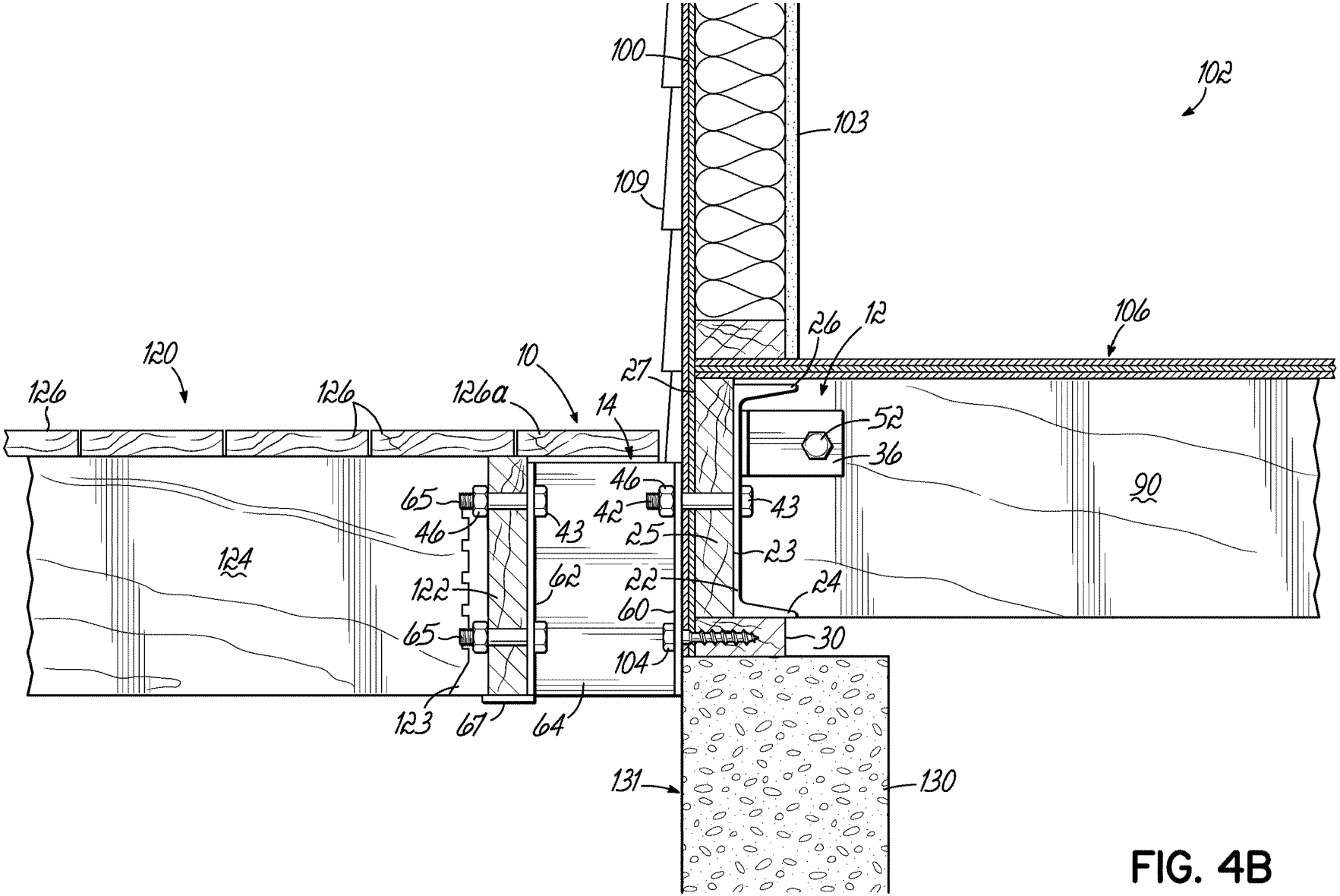
FIG. 4B is a side view, in partial cross-section, of a deck mounting system of the invention in another building installation.

FIG. 4B illustrates a similar installation of the mounting system of the invention on a building 102 including siding 109. However, a foundation wall 130 rather than a stud wall 103 is utilized. Because there is no need to support a portion of the brick veneer on the foundation wall 130, the band board 25 and floor joists structures 90 may extend out to the outer face 131 of the foundation wall as illustrated in FIG. 4B. As such, bracket 14 is mounted generally flush to the face surface 131 of the foundation wall and does not need to be notched to rest on the foundation wall. Other than that difference, the anchor frame 12, bracket 14, and elements of deck 120 are mounted similar to the installation as illustrated in FIG. 3B, for example.

FIG. 5 illustrates a scenario wherein the building 102 incorporates a siding veneer 109 similar to the installation of FIGS. 4A and 4B. However, in order to avoid the span distance provided by bracket 14 and the span portion 64 of that bracket, the mounting system as installed in FIG. 5 only incorporates the anchor frame 12 of the system. In such a scenario the ledger board 122 is mounted directly to the other side of the band board rather than to the second face portion 62 of bracket 14. That is, bolt element 42 extends through the ledger board 122 and band board 25 and bolt element 104 is screwed through the ledger board 122 and into the top plates 30. As may be appreciated, both of the bolt elements 42 and 104 may need to be extended in length to accommodate the thickness of the ledger board 122 versus the generally thinner face portion 60 of the bracket 14. The installation of FIG. 5 illustrates a joist hanger element 123, and similar joist hanger elements may be incorporated within the deck 120 of the other installations as shown in the figures. As such, the joists bracket 123 is not considered part of the invention but is a known way of coupling joists 124 with the ledger board 122 of the deck 120.

Figure 6:
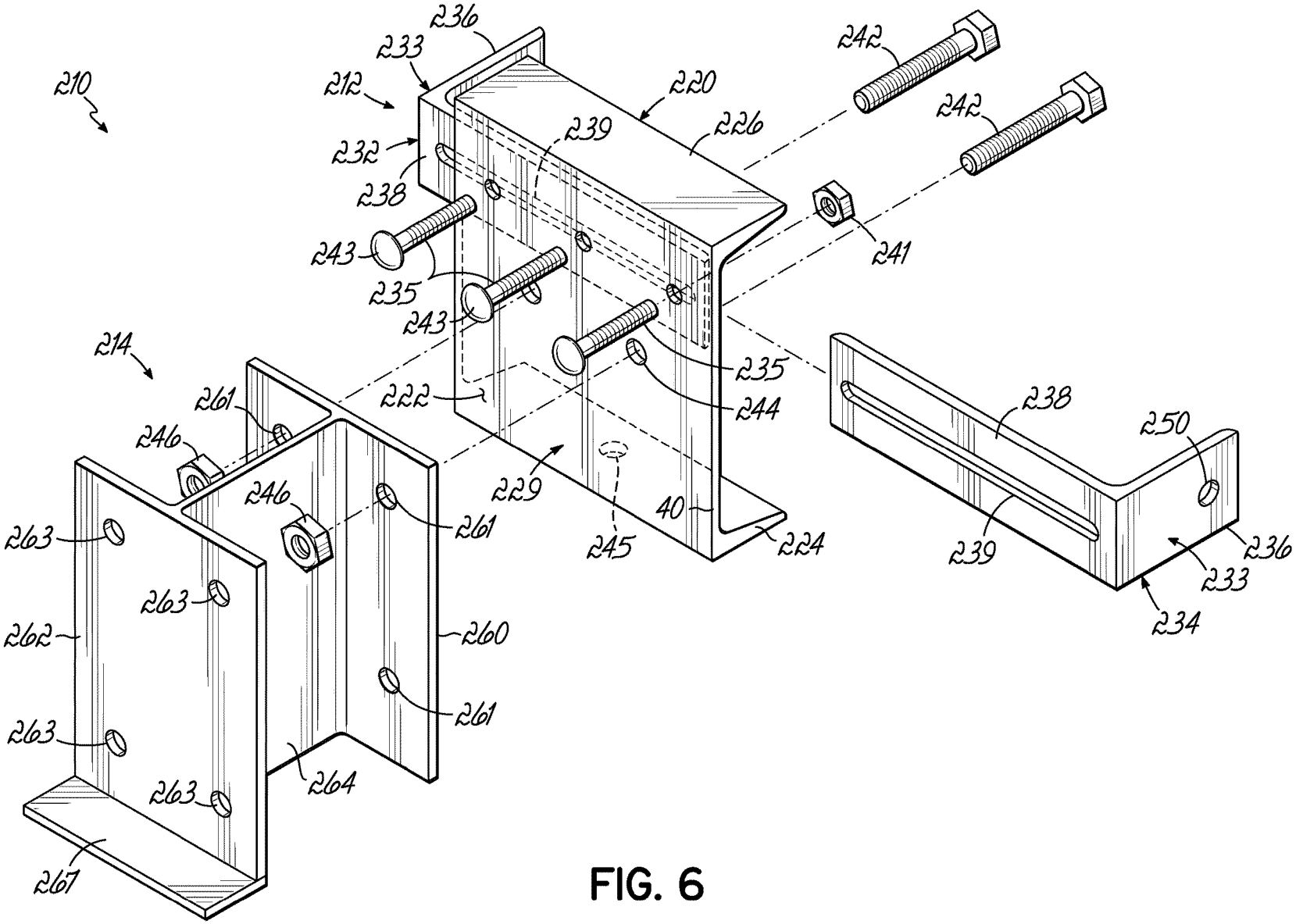
FIG. 6 is an exploded perspective view of a deck mounting system in accordance with another embodiment of the invention.

FIG. 6 is an exploded perspective view of another embodiment of a mounting system 210 of the invention for mounting an external structure with the building. The mounting system 210 includes an anchor frame 212 and a bracket 214 that may be secured with the anchor frame 212 for certain installations as discussed herein. That is, for some installations, the anchor frame 212 may be utilized alone and for other installations, the anchor frame is utilized in combination with the bracket.

Figure 8A:
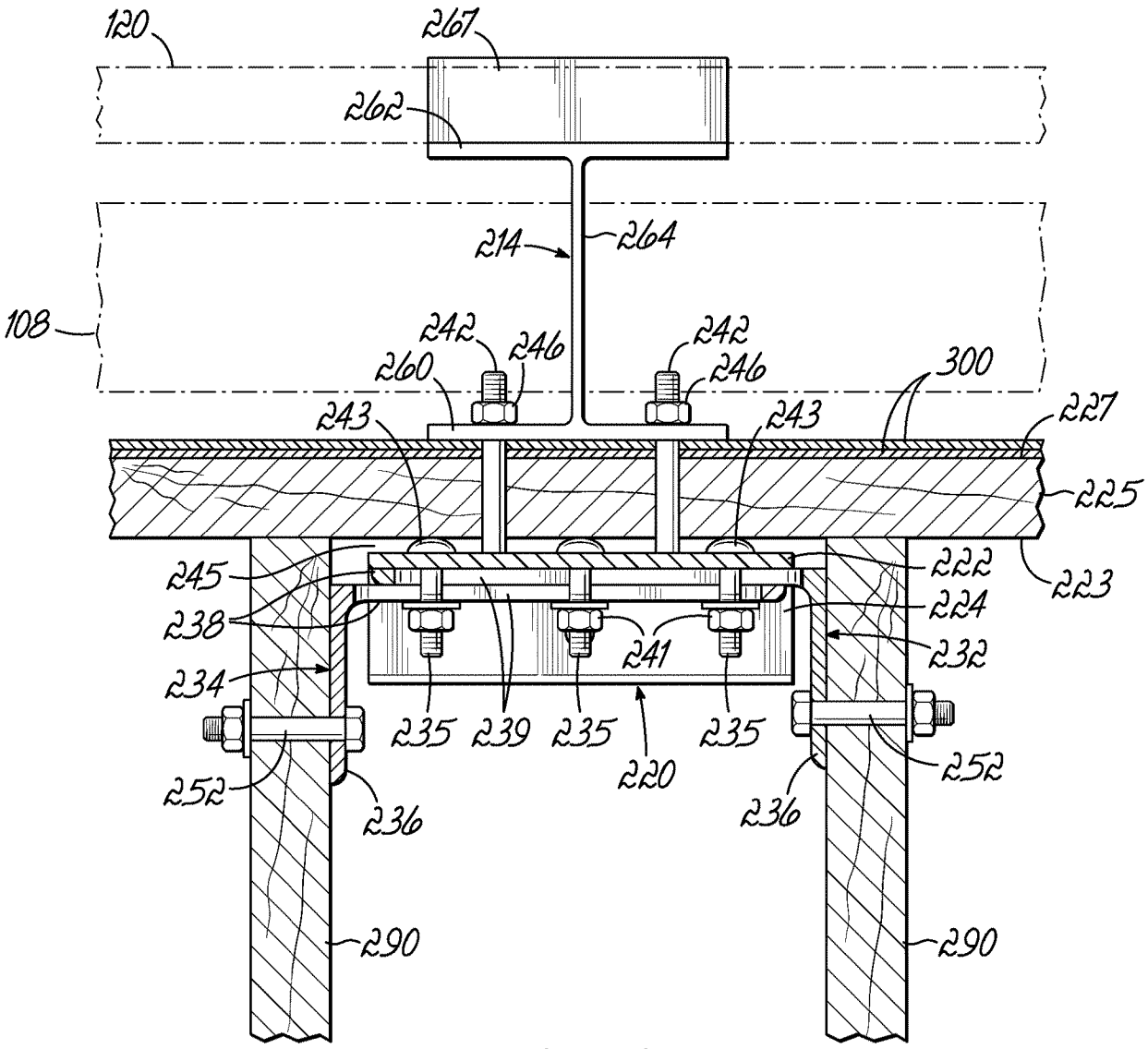
FIG. 8A is a plan view, in partial cross-section, of a deck mounting system of the invention in a building installation.

The anchor frame 212 is configured for mounting with structural elements of a building, such as floor elements, including band boards and floor joists as illustrated herein. In accordance with one aspect of the invention, the mounting system 210 has adjustable elements and features for providing installation in a number of different scenarios. The anchor frame includes a plate element 220 that has a planar portion 222 that is configured from mounting against a structural element, such as a band board. The planar portion 222 lies against a face 223 of the band board (see FIG. 8A). Such band boards are presented proximate the exterior wall of a building as shown in FIGS. 2D-5. More specifically, the plate element creates a planar surface 229 that lies against a face 223 of the board. The planar portion 222 is configured for lying up against an interior face surface 223 of a band board or some other situated board or surface when the anchor frame is installed as shown in FIG. 8A. In accordance with one embodiment of the invention, the anchor frame 212 is formed of a suitably rigid material such as steel. Although the anchor frame is discussed herein for use with a band board and perpendicular floor joist, other boards or surfaces in a building that are suitably oriented might be used with the anchor frame.

For example, in the illustrated embodiment as shown in FIG. 6, the plate element 220 of the anchor frame 212 may be formed with a length of steel channel stock. In one embodiment of the invention, the plate element 220 includes one or more lip portions 224, 226 that extend generally perpendicular to the planar portion 222. For example, if the plate element 222 is formed from channel stock, the sides of the channel might form the noted lip portions 224, 226. In the illustrated embodiment, the bottom lip portion 224 extends generally perpendicular to the planar portion 222 from a bottom end of that planar portion as illustration in FIG. 6. As shown in other figures herein, including FIG. 2D, the lip portion is configured for mounting against a structural element of a building, such as one or more top plates 230 in the wall of a building for further supporting and securing the anchor frame. In other embodiments of the invention, such as in FIGS. 10, 10A, the planar portion is unitary with anchor elements as discussed further herein.

The anchor frame further includes at least one anchor element and preferably a plurality of anchor elements 232, 234 that extend from the side of the planar portion 222. The one or more anchor elements 232, 234 are configured from mounting against another building structural element, such as a floor joist that is oriented perpendicular to the band board. However, the invention is not limited to a particular structural element or the names as used herein, and the mounting system might be incorporated with other similarly situated, yet differently named boards and other structural elements of a building.

Figure 7:
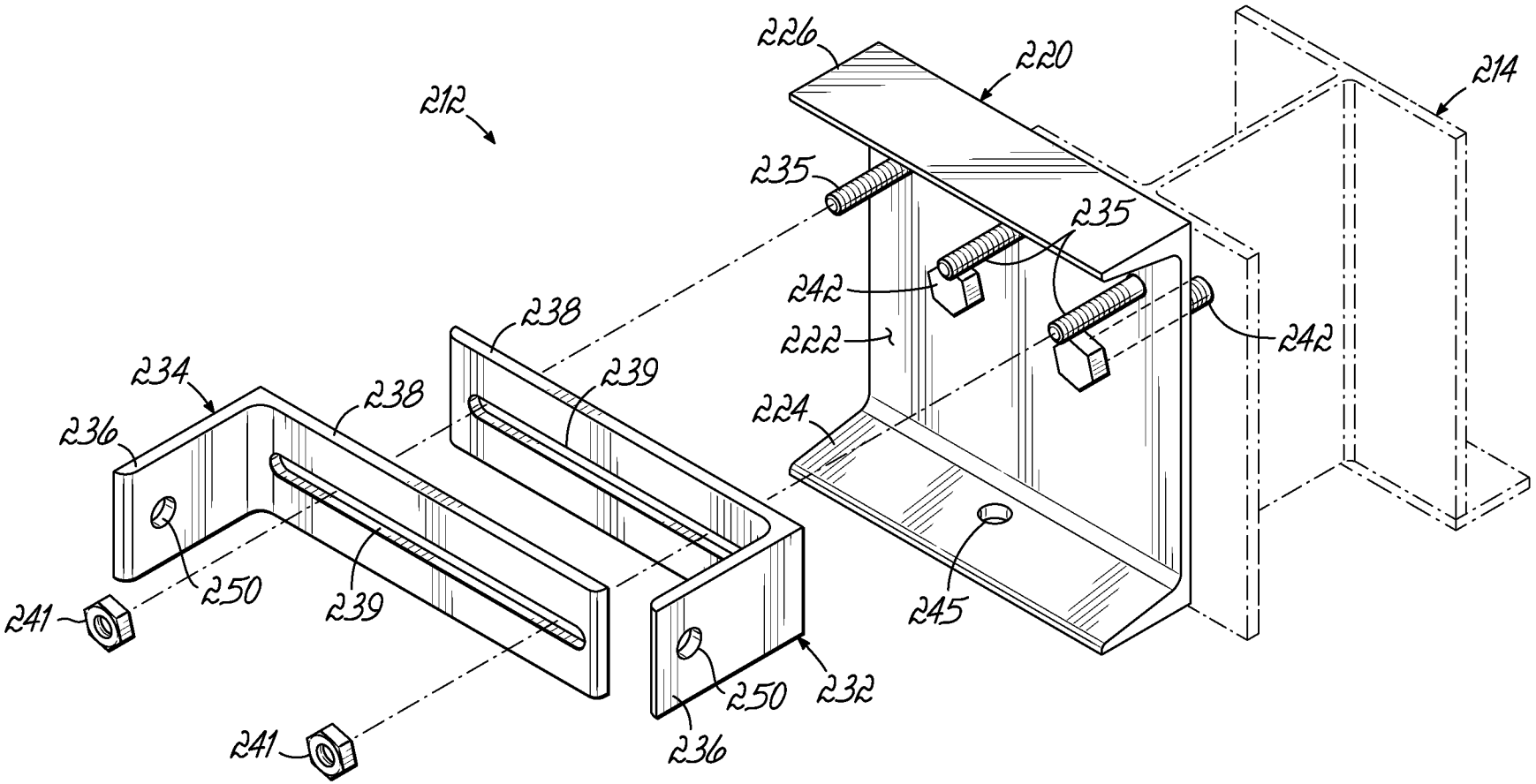
FIG. 7 is another perspective view of a deck mounting system of FIG. 6.
Figure 8B:
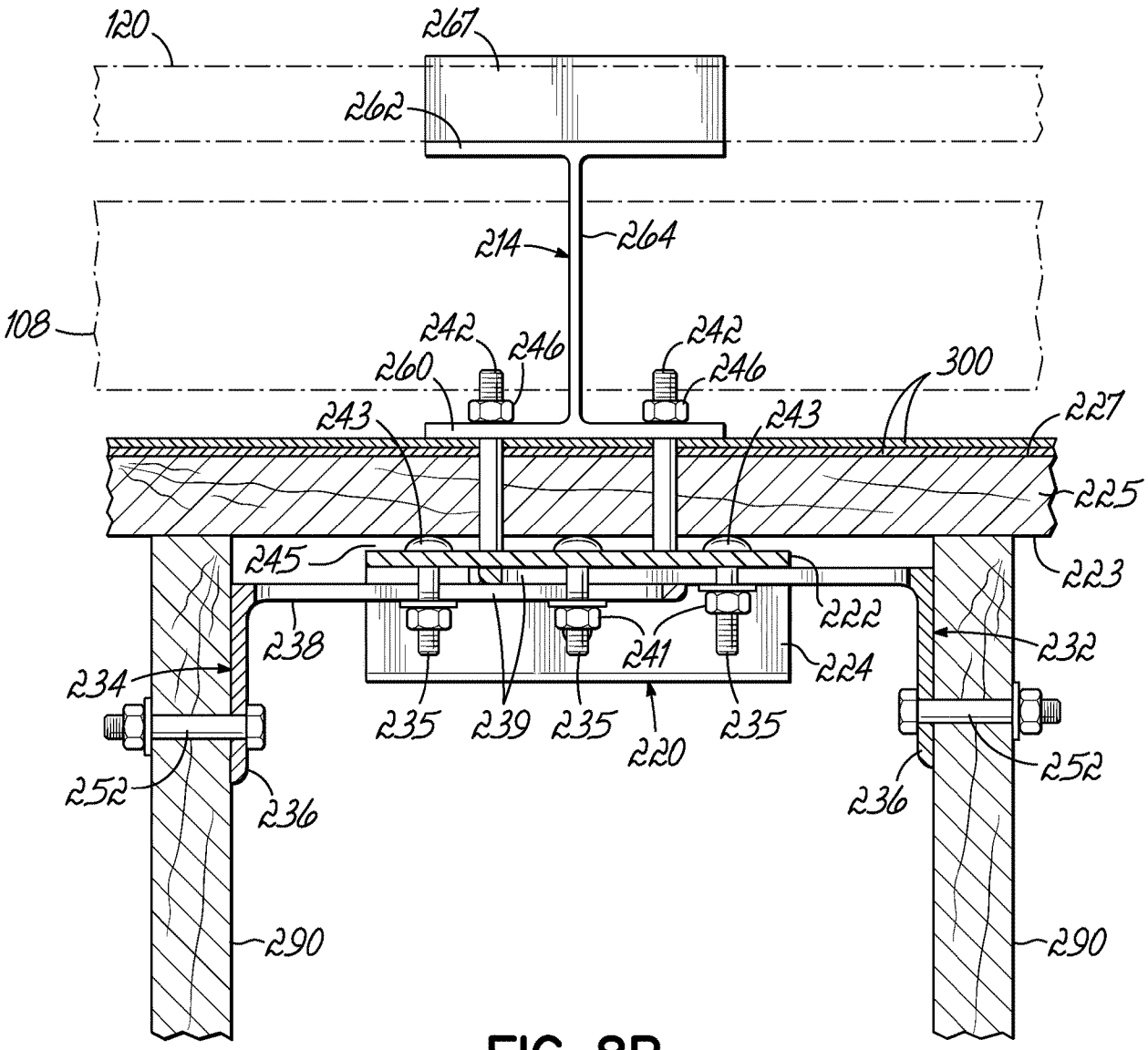
FIG. 8B is a plan view, in partial cross-section, of a deck mounting system of the invention in another building installation.
Figure 8C:
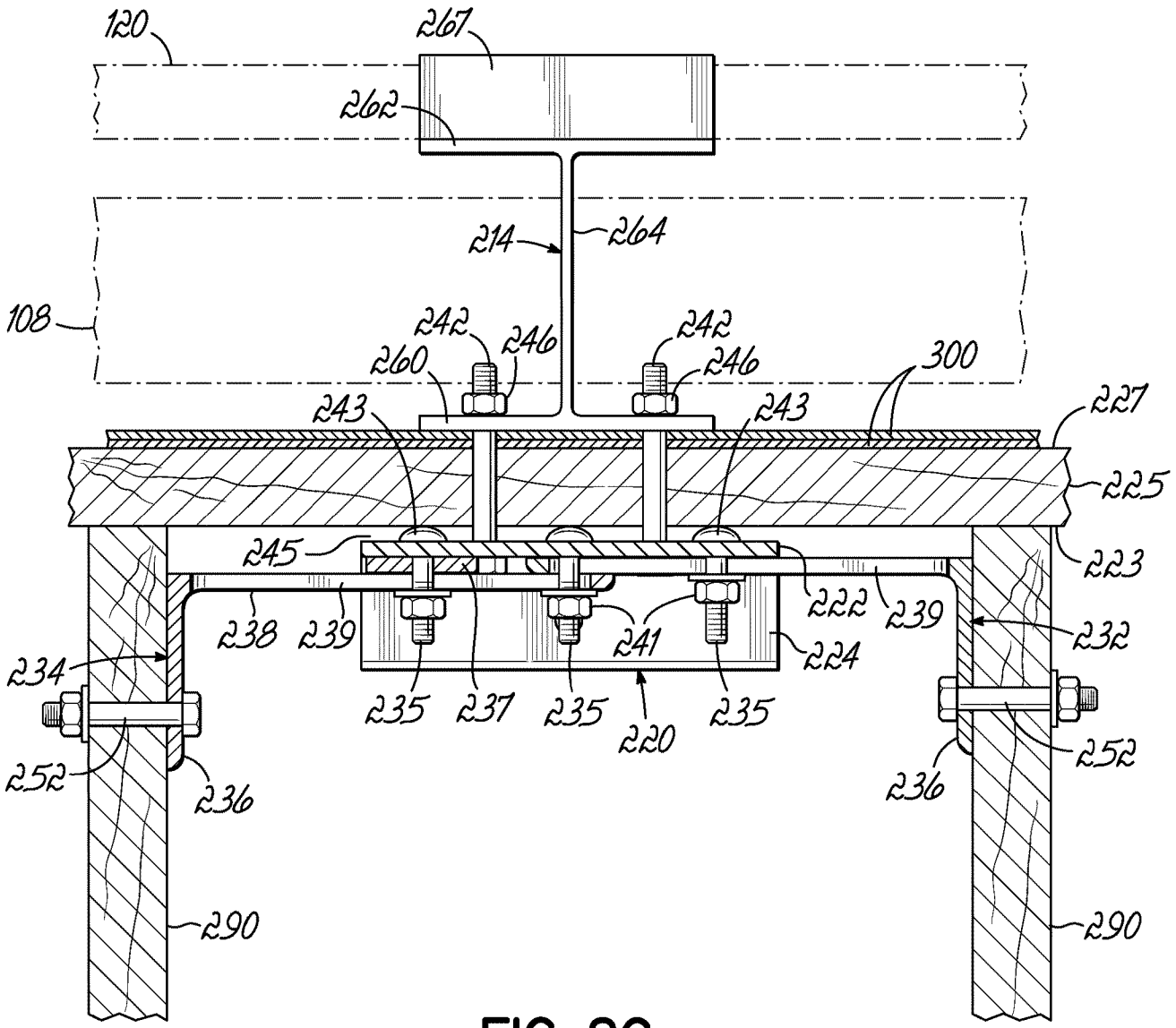
FIG. 8C is a plan view, in partial cross-section, of a deck mounting system of the invention in another building installation.

In accordance with one feature of the invention, the anchor elements are adjustable with respect to the anchor frame 212. More specifically, they slide on the planar portion of the plate element for varying the length of the anchor element with respect to the plate element and allow the anchor frame to have different effective widths to adapt to different floor joist spacing. The anchor elements 232, 234 extend from a side of the planar portion 222 and slide on posts, bolts or shafts 235 to spread to a suitable distance on opposite sides of the anchor frame for mounting with adjacent joists or other elements that are oriented perpendicular to the band board. As such, each anchor element 232, 234 includes an anchor portion 236 that is oriented generally perpendicular to the plane of the planar portion 222 of the anchor frame 220. For proper positioning and coupling of the anchor portions 236 with plate element 220, the anchor elements 232, 234 may also include suitable span portions 238 that space the respective anchor portions 236 on the anchor frame. In the illustrated embodiment, the span portions 238 include respective slots 239 that engage the posts 235 and allow the anchor elements to slide to different lengths with respect to the plate element of the anchor frame as shown in FIG. 8A-8C. This allows variation of the width of the anchor frame. The anchor elements slide on the posts and as shown in FIG. 7 can be fixed at the desired location. In that way, anchor frame 220 may be used in various different scenarios and may be adjusted to the joist widths. For example, in a residential building, the floor joists might be spaced in the range of 10-18 inches, and generally at 16 inches on center, and thus the anchor elements 232, 234 are configured for positioning anchor portions 236 at various suitable distances for mounting against a face or face surface of a floor joist. In that way, one anchor frame may be used in various different installation scenarios.

Figure 9:
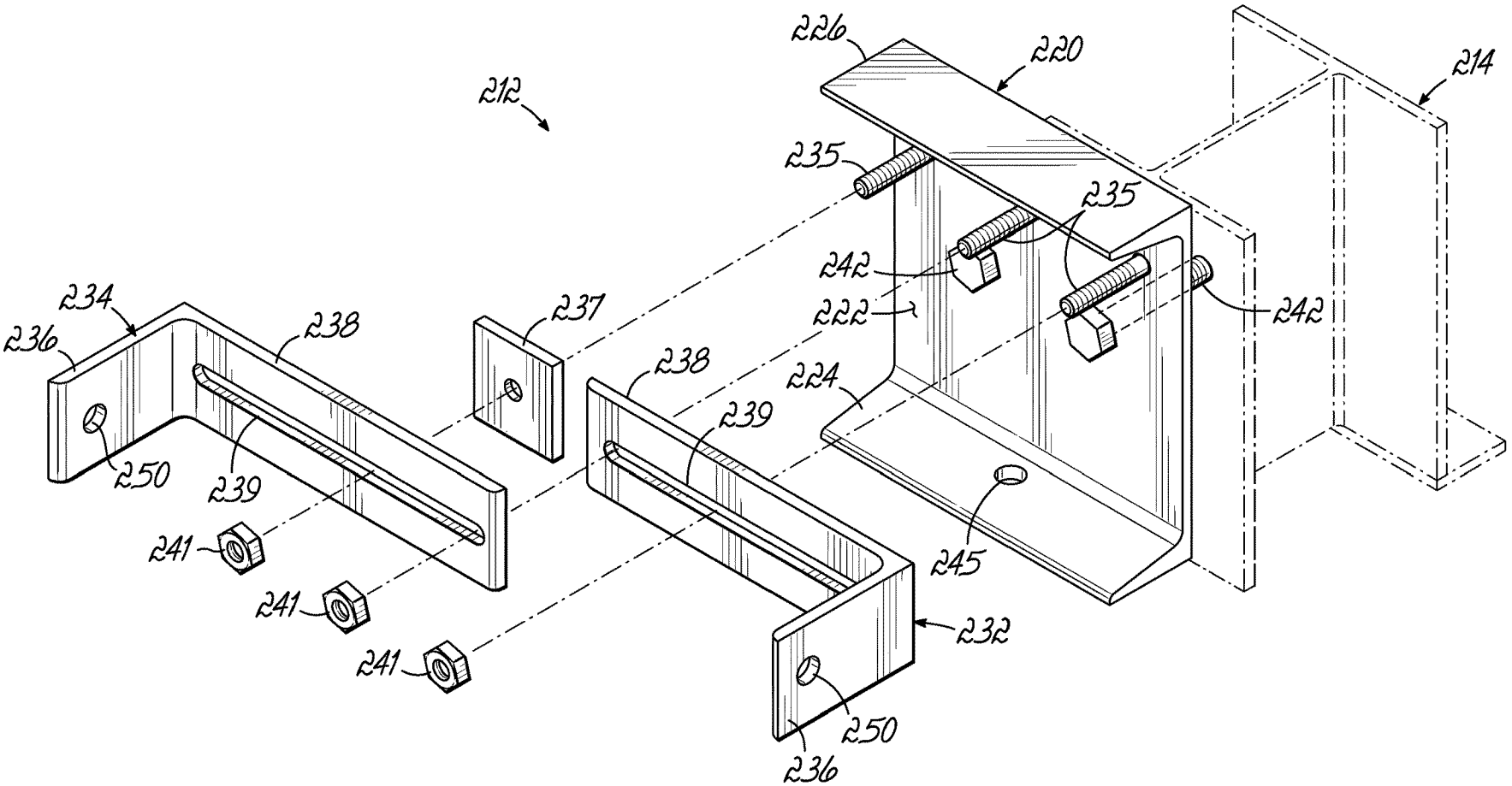
FIG. 9 is an exploded perspective view of a deck mounting system in accordance with another embodiment of the invention.

Once the anchor elements 232, 234 are positioned at a desirable distance, they can be fixed to the posts 235, such as with appropriate fasteners, such as nuts 241 shown in FIG. 7. In one embodiment as illustrated, the posts 235 are utilized to accommodate a variety of different widths for the anchor elements. Furthermore, as discussed herein, for a wide joist width, a spacer element 237 might be implemented as shown in FIG. 9, for example. Referring to FIG. 7, FIGS. 8A-8C, the anchor frame 212 may be secured to a band board and then the anchor elements 232, 234 might be slid on the posts 235 to the appropriate positions. The fasteners are loose to allow sliding in one installation, for floor joists that are closer together, each of the anchor elements 232, 234 may engage all of the posts 235. In the illustrated figures, three posts 235 are utilized, although a greater or lesser number of posts might also be utilized. During the installation, one element, such as anchor element 234 would overlie the other anchor element, such as anchor element 232. The posts 235 would pass through both of the slots 239 and the respective anchor elements and the anchor elements may be secured with nuts 241. In alternative installations, the floor joists might have a greater spacing or width therebetween and therefore, each of the anchor elements 232, 234 may only engage a couple of the posts 235, as illustrated in FIGS. 8B and 8C and discussed herein.

When installed, the anchor frame 212 is secured with the various structural elements of the building. To that end, fasteners, such as bolt elements may be utilized as illustrated in various of the Figures herein. For example, the mounting system may include one or more bolt elements 242 that are coupled or secured with the anchor frame. In the illustrated embodiment, the bolt elements extend through the planar portion 222 and particularly extend through holes or apertures 244 formed through the plate element 220 of the anchor frame. The bolt elements also extend from the planar portion 222 of the plate element 220 and through other structure elements for securing the plate element with an external structure, such as a band board. The bolt elements 242 may be threaded as illustrated in FIG. 6 and may include appropriate threaded nuts 246 that are coupled with the bolt elements 242 for proper securement to a board and to the bracket 214. The bolt elements may be separate from the anchor frame or may be secured to the anchor frame, such as with a weld. If welded, the bolt elements may be welded on one side of the plate element and extend through apertures 244 or may be welded or secured on the other side and thus not require any apertures.

In addition to securing the plate element 220 with a building structural element, the bolt elements 242 may also secure the anchor frame 212 with bracket 214 as illustrated and discussed herein. When the plate element is secured to a band board, the anchor portions 236 of anchor elements 232, 234 are also appropriately secured with respect to structural elements, such as floor joists. To that end, the anchor elements have a planar surface 233 as shown and include holes or apertures 250 formed therein for receiving other bolt elements, such as a bolts 252, as illustrated in FIGS. 2A, 82, and 2D. As illustrated, the planar surfaces 233 fit up against the flat surfaces of a joist or other board. The bolts 252 could be pass-through threaded bolts, as shown, or might be lag bolts. In some embodiments, and depending on the installation, the lower lip portion 224 may include an aperture 245 to receive a lag bolt to further secure the anchor frame 212. Depending upon the materials and the structural elements of the building with which the mounting system of the invention is used, the bolt elements may take a number of forms, such as traditional threaded bolts 242 and nuts which are used to couple metal elements of the mounting system together through one or more structural elements or threaded lag bolts as illustrated herein that may be screwed into suitable wooden structural elements as illustrated. Accordingly, the present invention is not limited to a particular construction of the bolt element that is used to secure the mounting system with or through certain of the structural elements of a building.

Referring again to FIG. 6, the mounting system, in certain installations, includes bracket 214 for coupling with anchor frame 212. Bracket 214 is formed of a suitably strong material such as steel and includes a first plate or face portion 260 for coupling with plate element 220 of the anchor frame 212. More specifically, as illustrated in the figures, face portion 260 is generally planar and is configured for mounting against the face surface 227 of a band board 225 of a building, opposite plate element 220, and specifically opposite the planar portion 222 of that plate element. As installed, the bracket face portion abuts against an outer face surface 227 of band board 225 (see FIG. 8A for example).

Bracket 214 further includes a second plate or face portion 262 that is spaced from the first face portion 260. The second face portion 262 is configured for mounting with an external structure, such as elements of an external deck structure as described herein. Coupling or connecting the first face portion 260 and second face portion 262 is a web or span portion 264 of the bracket that spaces the face portions from each other. As noted herein, the mounting system of the invention might be utilized with a building that includes a veneer structure, such as brick or some other material. As such, any external structure, such as a deck structure would be mounted spaced from the outside surface of structural elements of a building to address other veneer materials. To accommodate brick and other materials as illustrated in the Figures, the span portion 264 will provide a spacing between the face portions 260, 262 that will accommodate such materials. As such, the span portion 264 may have various suitable dimensions to achieve the spacing and the invention is not limited to a particular span. The face portions are secured with respective elements using bolt elements. The face portions 260, 262 of the bracket may include one or more respective apertures 261, 263 for accommodating bolt elements to secure the bracket 214 to the anchor frame 212 as well as to secure the bracket to structural elements of the building. Apertures 263 are used to connect structural elements of the external structure (e.g. a deck) with the mounting system. For example, referring to FIG. 2D, such bolt elements 65 may be used with face portion 262 and may be loose or may be fixed with the bracket, such as by welding. As shown in FIG. 6, certain of the apertures 261 in face portion 260 may receive the bolt elements 242 for coupling the anchor frame 212 and bracket 214. Other apertures 261 of face portion 260 and apertures 263 of face portion 262 may accommodate other bolt elements. For example, lag bolts might be screwed into suitable structural elements of the building or external structure as described herein.

In accordance with one embodiment of the invention, the various planar components and portions of the steel anchor frame 212 and bracket 214 might be welded together with separate steel plates to form the invention. In another embodiment, the anchor frame 212 and bracket 214 may be fabricated from steel elements, such as channel elements, angle elements, and H-beam elements. The anchor frame 212 and bracket 214 may otherwise be similar in construction and dimensions to elements 212, 214 as further described herein with respect to FIGS. 2A-2D, for example.

In installing anchor frame 212, a similar installation as discussed herein with respect to FIGS. 2A-2D may be implemented. However, because of the adjustable width or dimensions of the anchor elements 232, 234, the anchor frame 212 may be positioned, such as against a band board, and then the anchor elements may be slid on posts 235 to properly engage opposing floor joists as shown in FIGS. 8A-8C. Referring again to FIG. 8A, the opposing floor joists 290 might be separated such that the anchor elements 232, 234 do not have to be moved apart significantly and thus may engage each of the posts 235 as shown. In that regard, span portions 238 of the anchor elements 232, 234 will overlie each other as seen in the cross-section of FIG. 8A. As shown in FIG. 8A, depending upon the head or weld 243 of the posts 235, there may be a slight gap 245 between the inner portion 222 and the band board 225. Depending upon the softness of the wood, when the planar portion 222 is secured to the band board 225, some of the head or weld 243 may be driven into the soft wood of the band board.

Once the anchor elements 232 and 234 are in place and the anchor portions 236 are up against the joists 290, appropriate bolts 252 may be secured to the joists 290 to thereby anchor the anchor portions 236 with the joist and thereby secure the anchor frame 212. The anchor frame 212 may be further secured to structures, such as with bolts 242 and one or more lag bolts 92 as illustrated in FIG. 2A. Once the anchor frame 212 has been secured with structural elements of a building such as the band board and floor joists, and the bracket 214 has been secured with the anchor frame 212, other structural elements may be secured, such as external brick veneer 108 and an external deck 120 as shown in FIG. 8A.

To secure the anchor elements 232, 234, bolts 252 are passed through apertures 250 formed in the anchor elements and may be passed through the anchor board, such as the floor joist. Specifically, the adjustable anchor elements include anchor portions 236 that are also oriented generally perpendicular to the planar portion 222 of plate element 220. As such, when the plate element 220 is oriented against the interior face 223 of band board 225, the appropriately positioned anchor portions 236 of the anchor elements will lie against a face surface of the floor joists 290 (see FIG. 8A-8C). The anchor portions may then be appropriately secured with the bolt elements, such as bolts 252. In that way, as shown in FIG. 8A, the anchor frame may be secured with the structural elements inside of a building and behind board 225. As will be appreciated, depending upon the dimensions of the anchor frame as well as the placement of the various bolt elements 242, in order to place anchor frame against band board 225, holes will have to be marked and drilled or otherwise made in the band board 225 so that the bolt elements 242 may pass therethrough. This would have to be done before seating the anchor frame, particularly in those scenarios where the bolts 242 are welded to the anchor frame. Furthermore, there might be other external layers 300 on the outside of the band board 225 and on the outside of the building, and thus holes would have to be formed therethrough as well (see FIG. 8A). As may be appreciated, a template might be utilized for drilling the appropriate holes through the band board 225 and other layers 300 so that the anchor frame may be properly mounted against the band board and floor joists.

As illustrated herein, in some installation scenarios, the mounting system may only have to utilize the anchor frame 212 for securing an external structure, such as a deck as described herein. However, for various other installations, the mounting system utilizes the bracket 214 that couples with the anchor frame 212 for the mounting system as shown in FIGS. 8A-8C. Referring to FIG. 8A, once the anchor frame has been installed, the various bolt elements 242 are presented at an outer surface of the board 225. Bracket 214 may then be secured with the anchor frame 212 and the band board 225 through bolt elements 242 and other possible bolt elements. Specifically, the first face portion 260 is configured for being mounted against outer surface 227 of band board 225 (and intervening layers 300) as shown in FIG. 8A. As such, as illustrated in FIG. 8A, when the bracket is mounted, the first face portion is positioned opposite the plate element 220 and specifically opposite the planar portion 222 of the plate element and on the other side of the board 225. As discussed herein, reference to mounting against the band board, against a floor joist, or against some other element does not require that certain portions of the mounting system actually contact such band boards, floor joists, or other structural elements. That is, there may be other layers, such as insulating layers, waterproof layers, and other suitable materials or layers against those building structural elements and thus between the structural elements and components of the mounting system. As such, when a portion or element of the mounting system is mounted against such a structural element, it includes a scenario of mounting against other additional layers that overlie a face surface of the structural element.

Referring to FIG. 8A, the first face portion 260 of the bracket 214 mounts against band board 225 through the additional layers 300 as noted. To secure bracket 214 with anchor frame 212, the bolt elements 242 extend through appropriate apertures 261 in the first face portion 260 as shown in FIGS. 6 and 7, and the bolt elements are secured with the appropriate nuts 246. Accordingly, the mounting system of the invention captures the board 225 between elements of the mounting system to tie the system into the building structure. As such, load of the deck or other structure is transferred to the entire board and not just to anchors or bolts extending into the board. Furthermore, as discussed herein, the mounting system also ties in directly to the floor joists for further load bearing and support.

In one embodiment of the invention the bolt elements 242 extend from or through the planar portion of the plate element 220 generally in the middle of the plate element as shown in FIGS. 5, 6, and 7. Depending upon the positioning of the apertures 261, the first face portion 260 and bracket 214 may be offset slightly below the position of the anchor frame 212 in the building. As such, the bracket 214 is positioned vertically lower on the outside of building than the anchor frame is inside the building. Other apertures 261, formed within the first face portion 260 at positions below those apertures 261 that receive the bolt elements 242, align with other structural elements, such as the top plates 30 inside the building (see FIG. 2D). To that end, to further secure bracket 214 with the structural elements of the building and independently of anchor frame 212, bolt elements such as lag bolts may be screwed through the lower apertures 261 in the first face portion and screwed into the top plates 230 as discussed herein (see FIG. 2D). Once secured, the bracket 214 is thus tied to and supported by the structural elements of the building including the band board 225 and floor joists 290.

Once the bracket 214 is secured with anchor frame 212 and thereby with structural elements of the building, the second face portion 262 is exposed and spaced from the first face portion and presents a plurality of other bolt elements, such as bolt element 265 externally on the building. (See FIG. 2D for example.) Those bolt elements 265 are then secured to structural elements of an external structure, such as the ledger board or other similar board or element of a deck structure as illustrated herein. Those bolt elements 265 may be appropriately threaded and secured with threaded nuts similar to the bolt elements 242 and nuts 246. As noted, the bolt elements might be fixed to the bracket and the heads 269 or other portions of the of the bolt elements 265 might be welded to the second face portion 262 in the embodiment of FIGS. 6 and 7.

The mounting system may be positioned along the side of a building at various positions as dictated by the dimension of the deck or other external structure. That is, several mounting systems of the invention will be used to support a structure in most installations. For example, a mounting system 210 as disclosed might be positioned every 2 to 5 feet along a deck for proper support.

FIGS. 8B and 8C illustrate installation of an embodiment of the invention for floor joists that are spaced slightly farther apart than the floor joists 290 in FIG. 8A. Specifically, as noted, the mounting system 210 has the adjustable features which allow it to be utilized in a number of different installations regardless of the spacing of the floor joists. That is, the mounting system 210 may be adjusted, on-the-fly, during installation to adapt to a number of different scenarios. Referring to FIG. 8B, the floor joists 290 are separated more than those in FIG. 8A. Accordingly, it would not be possible to engage each of the posts 235 with the entire anchor element 232, 234. To that end, as illustrated in FIG. 8B, the anchor elements may be slid and secured on fewer post elements, such as two post elements as shown. That is, each of the anchor elements would be secured on two post elements when tightened down. As shown, in the installation of FIG. 8B, both anchor elements would still share the middle post elements. In the installation of FIG. 8B, the joists 290 are not so far apart such that they would prevent the anchor elements from having significant overlap with each other. That is, anchor element 234 would still significantly overlap anchor element 232 such that anchor element 232 thereby provides a suitable interface between anchor element 234 and planar portion 222.

Turning now to the installation as shown in FIG. 8C, if it is necessary to further move the anchor elements 232, 234 further apart to interface with the joist 290 there may not be a significant amount of overlap between anchor element 232 and anchor element 234 as shown in FIG. 8C. That is, there may only be slight overlap proximate to the center most post or posts 235. In the embodiment as illustrated in FIGS. 8C and 9, it may be desirable to incorporate a spacer elements 237 with the underlying anchor element, such as anchor element 232. The spacer element 237 engages a post and is positioned next to an anchor element engaging adjacent posts. The spacer element might be of a similar thickness as each of the anchor elements 232 234, and specifically similar to the adjacent anchor element 232. In that way, it will extend the overlap interface between anchor elements 232 and 234 and thereby provide a good base for tightening nuts 241 against the posts 235 as illustrated in FIG. 8C. The embodiment as illustrated FIGS. 8C and 9 would otherwise operate similarly to the embodiment as illustrated in FIGS. 6 and 7 and described herein.

Figure 10:
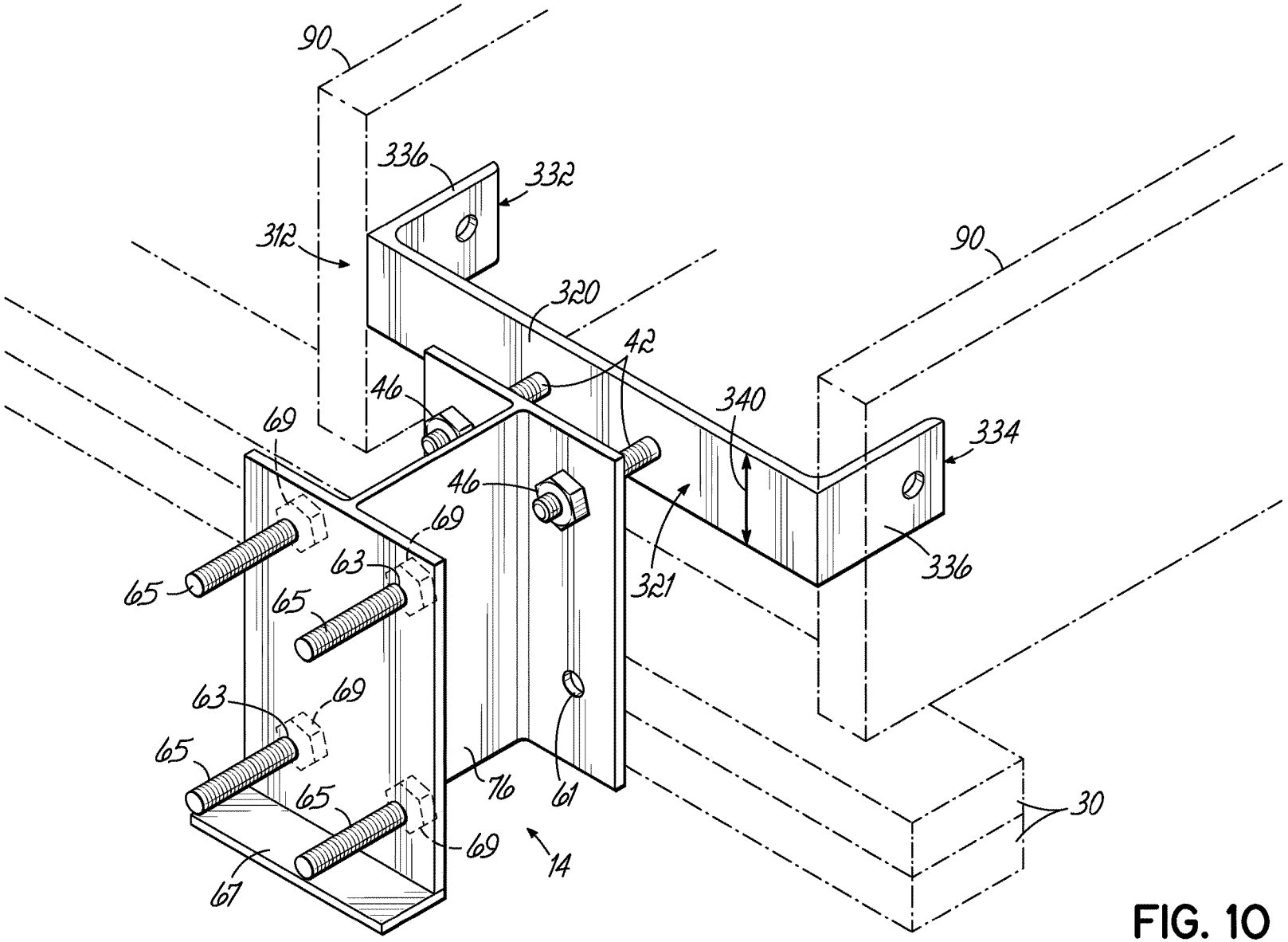
FIG. 10 is a perspective view of a deck mounting system in accordance with another embodiment of the invention in a building installation.
Figure 10A:
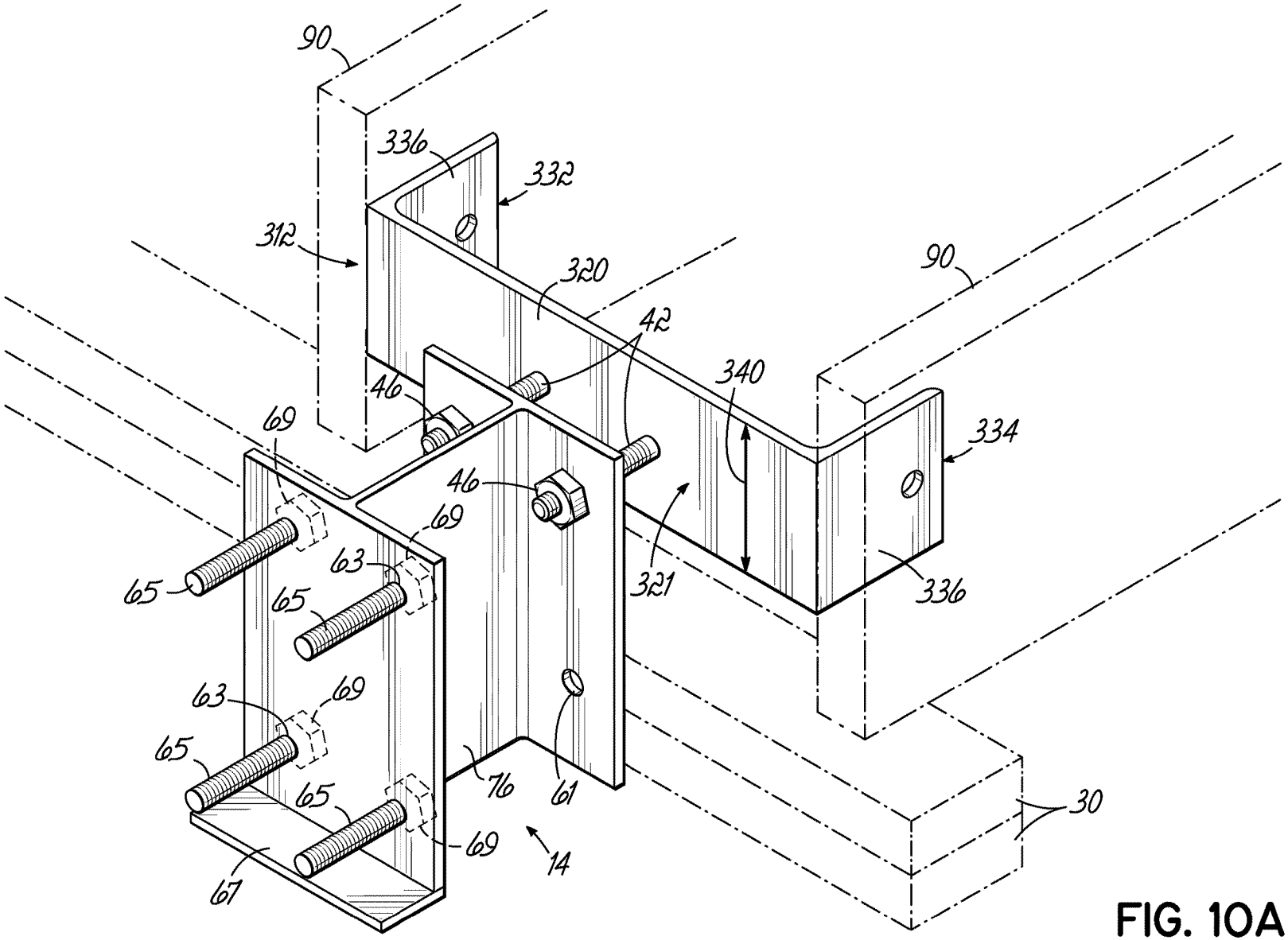
FIG. 10A is a perspective view of a deck mounting system in accordance with another embodiment of the invention in a building installation.

FIGS. 10 and 10A illustrate additional alternative embodiments of the invention. Therein, the mounting system incorporates an anchor frame 312 that comprises a unitary structure including the plate element 320 and the various anchor elements 332 and 334 that are coupled together to form the unitary structure or unitary plate element. The unitary plate element has a planar portion with a planar surface 321 for fitting up against a board. For example, the anchor frame 312 might be formed out of a single element that fits up against a band board and spans between the floor joists to present the anchor portions 336 proximate to the joists 290 as shown in FIG. 10. The plate element and anchor elements are generally in the same plane as shown. The anchor frame 312 can be installed similarly to other embodiments as disclosed herein and may be utilized individually or with a bracket 214 as shown in FIG. 10. The vertical dimension 340 of the anchor frame 212 may be varied as illustrated between FIGS. 10 and 10A in order to provide a proper amount of surface bearing against the band board and also proper anchoring in engagement with the opposing joists 90. Otherwise, the anchor frame 312 operates similarly as described herein with respect to other embodiments such as those shown in FIGS. 1-5.

Figure 11:
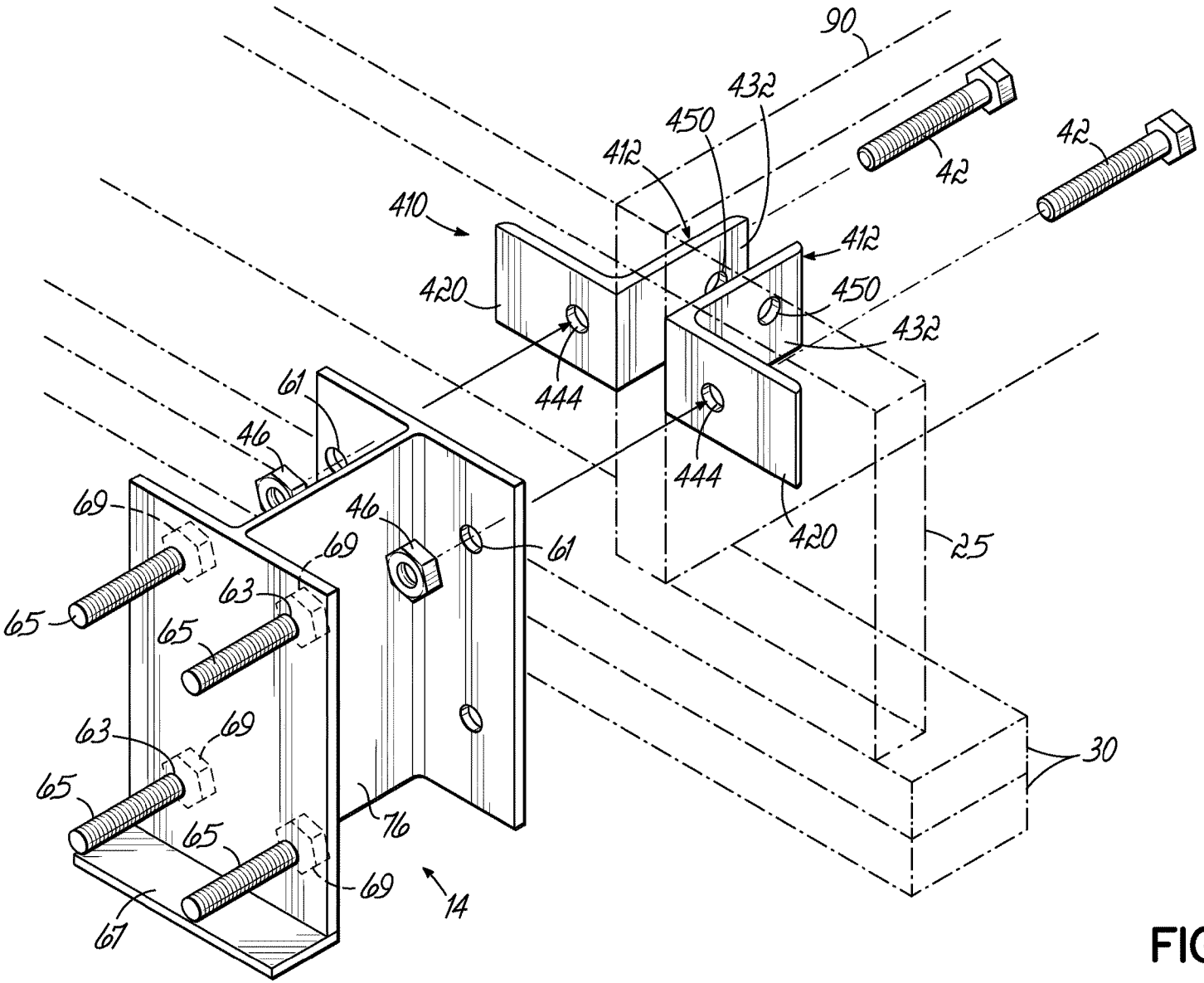
FIG. 11 is a perspective view of a deck mounting system in accordance with another embodiment of the invention in a building installation.

FIG. 11 illustrates a further alternative embodiment of the invention wherein the system 410 incorporates a plurality of anchor frames 412 that engage a single joist from either side of the joist. Specifically, the anchor frames 412 each include plate elements 420 and adjacent anchor elements 432 that extend generally perpendicular to the plate elements 420. Each of the plate element 420 and anchor element 432 include appropriate openings or apertures therein 444, 450 receiving bolts or other fasteners to secure anchor frames 412 with a band board and the joists. For example, bolts such as 42 may secure the anchor frames with the band board also with an external bracket 14. In the embodiment of FIG. 11, the system 410 engages opposing sides of a floor joist 90 as opposed to spanning between floor joists as in other embodiments. To that end, if the frames 412 are vertically aligned, a single faster might be incorporated through apertures 450 in each of the anchor elements 432. Therefore, the anchor frames 412 cooperate on either side of a joist 90 and secured with the joist and with a band board as shown. Thereafter, the external structures, such as bracket 14 or other structures may be coupled with the anchor frames 412 for securing an external structure, such as a deck with a house or other building. The various anchor frames 412 may have construction and dimensions, such as thickness dimensions for the plate elements 420 and anchor elements 432 as similar elements of the embodiments disclosed herein. Similarly, bracket 14 can resemble the other brackets as disclosed in other figures.

Additional embodiment as illustrated in FIGS. 6-11 may be incorporated into the various installation scenarios as shown in FIGS. 3A-3B, 4A-4B, and 5 and discussed herein as appropriate for securing an external structure such as a deck securely and robustly to another structure for building, such as a house. As such, the various installation scenarios may be referred to as discussed herein with respect to FIGS. 3A-3B, or 4A-4B and 5 for the environment.

While the present invention has been illustrated by a description of various embodiments and while these embodiments have been described in some detail, it is not the intention of the inventors to restrict or in any way limit the scope of the appended claims to such detail. Thus, additional advantages and modifications will readily appear to those of ordinary skill in the art. The various features of the invention may be used alone or in any combination depending on the needs and preferences of the user.

What is claimed is:

1. A mounting system for mounting an external structure with a building comprising:

an anchor frame configured for mounting with structural elements of the building, the anchor frame including:

a plate element having a planar surface configured for mounting against a first board of the building;

at least one anchor element extending from a side of the plate element, the anchor element including an anchor portion oriented substantially perpendicular to the plate element and configured for mounting against a second board of the building that is positioned to the side of the plate element and is oriented perpendicular to the first board;

the at least one anchor element configured for sliding with respect to the plate element for varying a length of the anchor element with respect to the plate element and a spacing of the anchor portion from the plate element;

a plurality of fasteners configured for securing the anchor frame with the building, at least one fastener of said plurality extending through the plate element for engaging the first board and at least another fastener of said plurality extending through the at least one anchor element for engaging the second board and for securing the anchor frame with the boards.

2. The mounting system of claim 1 wherein the plate element is configured for mounting with a band board of the building.

3. The mounting system of claim 1 wherein the at least one anchor element is configured for mounting with a floor joist board of the building.

4. The mounting system of claim 1 further comprising a bracket for coupling with the anchor frame, the bracket including:

a first face portion configured for mounting against the first board, opposite the plate element, the bolt element extending through the plate element and the first face portion of the bracket for securing the bracket with the plate element on either side of the first board;

a second face portion spaced from the first face portion, the second face portion configured for mounting with the external structure.

5. The mounting system of claim 1 wherein the anchor frame includes a post and the at least one anchor element includes a slot that engages the post for allowing the anchor element to slide with respect to the plate element.

6. The mounting system of claim 5 wherein the anchor frame includes a plurality of posts and the at least one anchor element includes a slot that engages multiple posts of the plurality of posts.

7. The mounting system of claim 6 further comprising a spacer element, the spacer element engaging at least one post that is next to a post engaged by the at least one anchor element.

8. The mounting system of claim 1 wherein the at least one anchor element further includes a plurality of anchor elements, a respective said anchor element extending from each opposing side of the plate element, each of the plurality of anchor elements including a respective anchor portion and configured for sliding with respect to the plate element for varying the length of the anchor elements with respect to the plate element and the spacing of the respective anchor portions from the plate element.

9. The mounting system of claim 8 wherein the anchor frame includes a post and each of the anchor elements includes a slot that engages the post for allowing the anchor elements to slide with respect to the plate element and with respect to each other to vary an effective width of the anchor frame.

10. The mounting system of claim 8 wherein one of the anchor elements slides on top of another anchor element.

11. A mounting system for mounting an external structure with a building comprising:

an anchor frame configured for mounting with structural elements of the building, the anchor frame including:

a plate element having a planar surface configured for mounting against a first board of the building;

at least one anchor element extending from a side of the plate element, the anchor element including an anchor portion oriented substantially perpendicular to the plate element and configured for mounting against another board of the building that is positioned to the side of the plate element and is oriented perpendicular to the first board;

the at least one anchor element configured for sliding with respect to the plate element for varying a length of the anchor element with respect to the plate element and a spacing of the anchor portion from the plate element;

a bracket for coupling with the anchor frame and including:

a first face portion configured for mounting against the first board, opposite the plate element;

a bolt element configured for coupling the plate element and face portion together through the first board for securing the bracket with the plate element on either side of the first board;

a second face portion spaced from the first face portion, the second face portion configured for mounting with the external structure.

12. The mounting system of claim 11 wherein the at least one anchor element further includes a plurality of anchor elements, a respective said anchor element extending from each opposing side of the plate element, each of the plurality of anchor elements including a respective anchor portion and configured for sliding with respect to the plate element for varying the length of the anchor elements with respect to the plate element and the spacing of the respective anchor portions from the plate element.

13. The mounting system of claim 12 wherein the anchor frame includes a post and each of the anchor elements includes a slot that engages the post for allowing the anchor elements to slide with respect to the plate element and with respect to each other to vary an effective width of the anchor frame.

14. The mounting system of claim 11 wherein the anchor frame includes a post and the at least one anchor element includes a slot that engages the post for allowing the anchor element to slide with respect to the plate element.

15. The mounting system of claim 14 wherein the anchor frame includes a plurality of posts and the at least one anchor element includes a slot that engages multiple posts of the plurality of posts.

16. The mounting system of claim 15 further comprising a spacer element, the spacer element engaging at least one post that is next to a post engaged by the at least one anchor element.

17. A mounting system for mounting an external structure with a building comprising:

an anchor frame configured for mounting with structural elements of the building, the anchor frame including:

a unitary structure including a plate element with a planar surface configured for mounting against a first board of the building and unitary anchor elements extending from each of opposing sides of the plate element, the anchor elements each including an anchor portion oriented substantially perpendicular to the plate element and configured for mounting against respective second and third boards of the building that are positioned on the opposing sides of the plate element and are oriented perpendicular to the first board;

a plurality of fasteners configured for securing the anchor frame with the building, at least one fastener of said plurality extending through the plate element for engaging the first board and at least another fastener of said plurality extending through each of the anchor elements for engaging the respective second or third board and for securing the anchor frame with the respective second or third board.

18. The mounting system of claim 17 wherein the plate element is configured for mounting with a band board of the building.

19. The mounting system of claim 17 wherein the anchor elements are configured for mounting with a floor joist board of the building.

20. The mounting system of claim 17 further comprising a bracket for coupling with the anchor frame, the bracket including:

a first face portion configured for mounting against the first board, opposite the plate element of the unitary structure, the bolt element extending through the plate element and the first face portion of the bracket for securing the bracket with the plate element on either side of the first board;

a second face portion spaced from the first face portion, the second face portion configured for mounting with the external structure.

* * * * *